US008402682B2

(12) United States Patent
Boltz et al.

(10) Patent No.: US 8,402,682 B2
(45) Date of Patent: Mar. 26, 2013

(54) BLEACHER WITH ADVERTISING TUNNEL

(75) Inventors: Eric S. Boltz, Akron, OH (US); Scott A. Miller, Navarre, OH (US); Erik M. Baker, Massillon, OH (US)

(73) Assignee: Imaginethis Renovations, LLC, Navarre, OH (US)

( * ) Notice: Subject to any disclaimer, the term of this patent is extended or adjusted under 35 U.S.C. 154(b) by 76 days.

(21) Appl. No.: 12/891,970

(22) Filed: Sep. 28, 2010

(65) Prior Publication Data

US 2012/0073171 A1 Mar. 29, 2012

(51) Int. Cl.
*G09F 17/00* (2006.01)

(52) U.S. Cl. ..... 40/604; 40/603

(58) Field of Classification Search ..... 40/603, 40/604, 607.01; 248/228.1; 160/399, 402; 52/234, 235, 238.1, 239, 6, 8
See application file for complete search history.

(56) References Cited

U.S. PATENT DOCUMENTS

| | | | | |
|---|---|---|---|---|
| 2,540,584 | A | 2/1951 | Jaycox | |
| 3,537,201 | A * | 11/1970 | Friedrichsen et al. | 40/604 |
| 3,589,048 | A | 6/1971 | Mollet | |
| 4,375,134 | A | 3/1983 | Sheetz | |
| 4,879,848 | A * | 11/1989 | Gardner et al. | 52/8 |
| 4,890,403 | A * | 1/1990 | Dinan | 40/604 |
| 4,932,152 | A | 6/1990 | Barlotta et al. | |
| 5,090,145 | A | 2/1992 | Chiang et al. | |
| 5,246,194 | A * | 9/1993 | Garcia | 248/228.1 |
| 5,305,704 | A | 4/1994 | Olaniyan | |
| 5,333,425 | A * | 8/1994 | Nickerson et al. | 52/222 |
| 5,402,988 | A | 4/1995 | Eisele | |
| 5,407,178 | A | 4/1995 | Long | |
| 5,555,659 | A | 9/1996 | Hade | |
| 5,667,855 | A * | 9/1997 | Borden et al. | 428/8 |
| 5,685,099 | A | 11/1997 | Favata | |
| 5,732,494 | A | 3/1998 | Davey | |
| 5,916,091 | A * | 6/1999 | Schultz | 52/8 |
| 5,921,031 | A | 7/1999 | Williams | |
| 6,474,009 | B2 | 11/2002 | Hahn | |
| 6,510,663 | B2 | 1/2003 | Jourden et al. | |
| 6,530,165 | B2 | 3/2003 | Griesemer et al. | |
| 6,619,544 | B2 * | 9/2003 | Bator et al. | 235/381 |
| 6,719,276 | B1 | 4/2004 | Bush | |
| 7,240,637 | B2 | 7/2007 | Rosen | |
| 7,437,843 | B2 | 10/2008 | Lefebvre | |
| 7,997,560 | B2 | 8/2011 | Bergdoll | |
| 2004/0221972 | A1 * | 11/2004 | Tomlinson et al. | 160/327 |
| 2007/0209261 | A1 | 9/2007 | Stover et al. | |
| 2009/0266958 | A1 * | 10/2009 | Meersman et al. | 248/231.51 |

* cited by examiner

*Primary Examiner* — James Kramer
*Assistant Examiner* — Christopher E Veraa
(74) *Attorney, Agent, or Firm* — Sand & Sebolt

(57) ABSTRACT

An advertising display system including a bleacher having a seating surface and support beams below the seating surface and defining a primary chamber, and an advertising panel assembly mounted within the primary chamber and defining a secondary chamber. The primary chamber has a first end and a second end and the advertising panel assembly may include an intermediate advertising panel between a first and second advertising panel that define the sides of the secondary chamber. Additionally, a ceiling panel may extend between the top edges of the first and second panels.

23 Claims, 19 Drawing Sheets

22
38
40
86
26
34
94
88
98
90
96
36
47
46
48
56
56
28
50
76
44
42
54
52
30
74
58
60
62
64
72
66
32
68
70

BLEACHER WITH ADVERTISING TUNNEL

BACKGROUND OF THE INVENTION

1. Technical Field

The invention relates generally to advertising panels or display banners. More particularly, the invention relates to advertising panels or banners for display at stadiums or bleachers. Specifically, the invention relates to an advertising display system mounted within under a bleacher and forming a tunnel.

2. Background Information

Advertising is a large industry in the United States and includes both printed media and electronic formats. Printed media comes in a variety of forms and may include banners and advertising billboards.

While advertising banners or panels are well known in the advertising industry, they are generally held in place with eyelets welded in the corners of the banner and string or yarn secured through the eyelet to a pole. The banner length then must be precise to fit within the area defined by the support poles or an unsightly amount of string will be necessary to secure the advertising panel to the pole. Advantageously, the use of string to secure the banner makes removal and replacement extremely easy for both the owner, as well as for, vandals or thieves.

Banners are traditionally used in smaller venues such as high school football stadiums, along fences, or on the top of the back of a bleacher. As discussed above, traditional eyelets are typically used to secure banners to fences or bleachers. While the advertising banners may adequately display an image, they do not appear professional or particularly pleasing to the audience. Bleachers also typically include spaces underneath the seating area that can act as a pathway for patrons to walk from one end of the bleacher to the other. This space is defined by the beams supporting the seating area and is both a potential safety hazard and is aesthetically unappealing.

SUMMARY OF THE INVENTION

The present invention broadly comprises an advertising display system which includes a bleacher having a seating surface and support beams below the seating surface which define a primary chamber, and an advertising panel assembly mounted within the primary chamber and defining a secondary chamber.

The present invention also broadly comprises an advertising display system including a bleacher having a seating surface and support beams below the seating surface defining a primary chamber and an advertising panel assembly mounted within the primary chamber and defining a secondary chamber, where the primary chamber has a first end and a second end, and the advertising panel assembly a first and a second advertising panel that extend longitudinally beneath the bleacher. The advertising panel assembly further includes an intermediate advertising panel that extends at an angle between the first and second advertising panels.

BRIEF DESCRIPTION OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

The advertising display system of the present invention is indicated generally at 20, and is particularly shown in FIGS. 1 through 11. Display system 20 includes a panel fastening assembly and an advertising panel 32 that is selectively engageable therewith.

Figure 1:
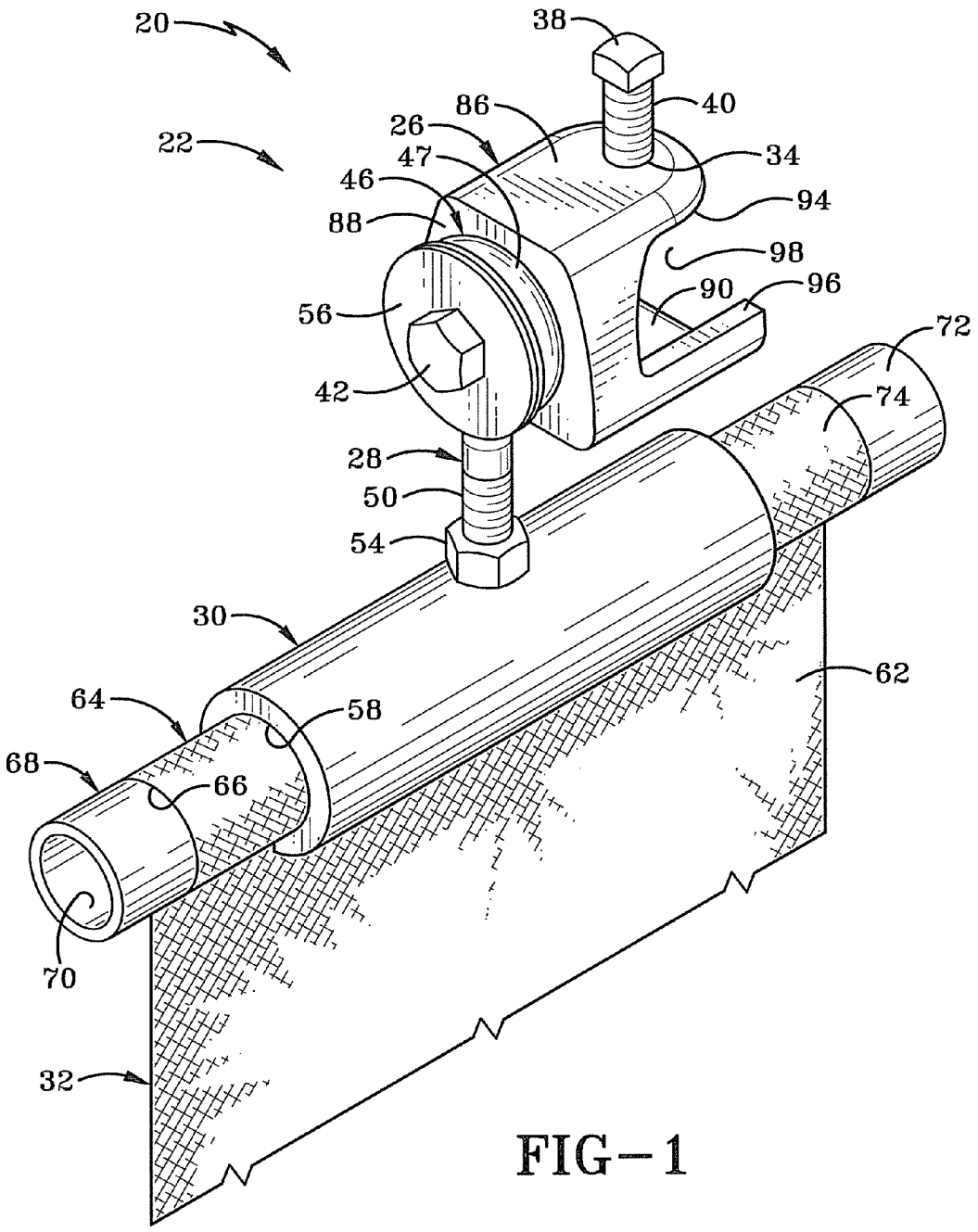
FIG. 1 is a perspective view of a first preferred embodiment of a panel fastening assembly used in an advertising display system in accordance with the present invention.
Figure 2:
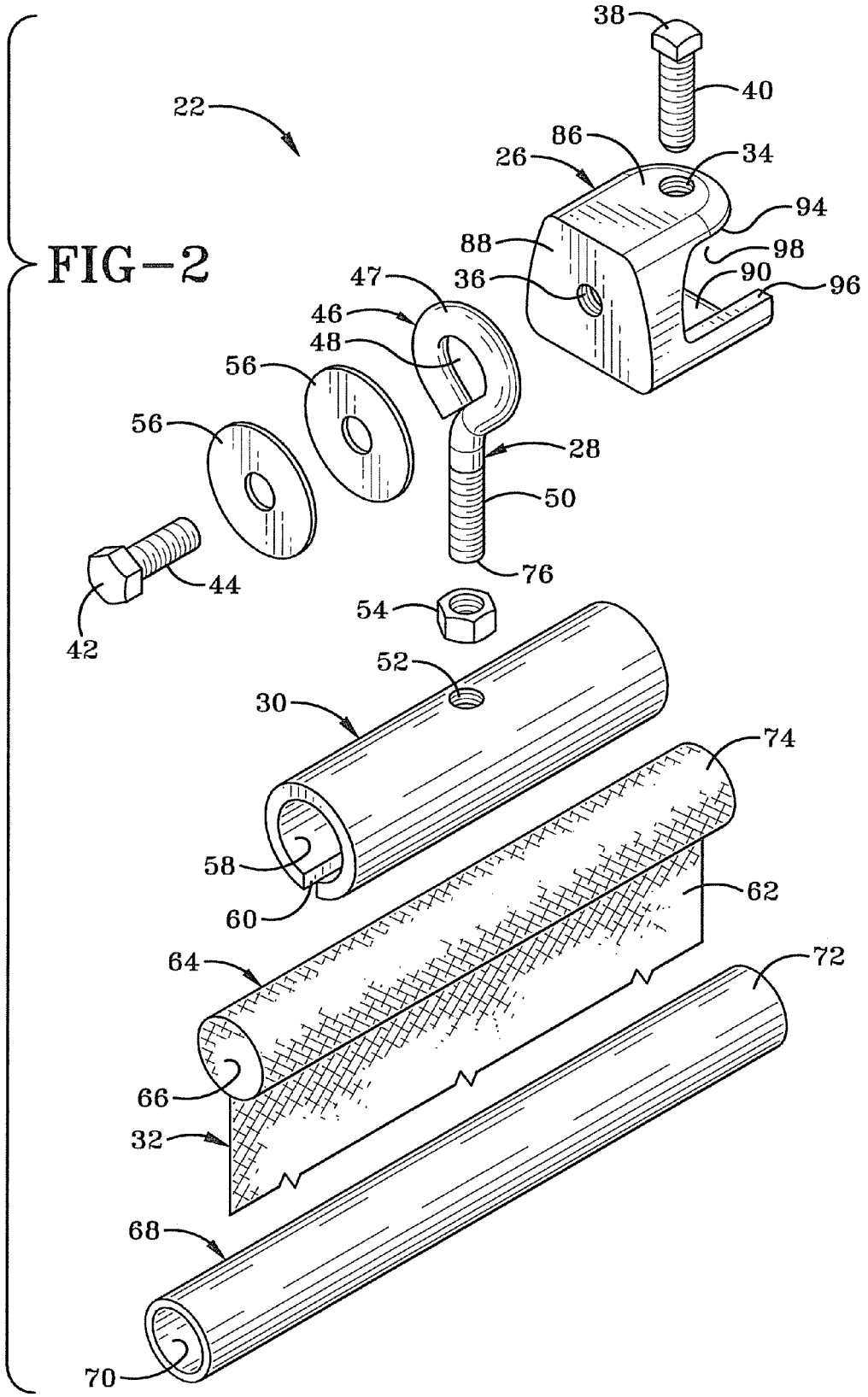
FIG. 2 is an exploded view of the panel fastening assembly of FIG. 1.

FIGS. 1 and 2 show a first preferred embodiment of a panel fastening assembly in accordance with the present invention, with the assembly being generally indicated at 22. Panel fastening assembly 22 comprises a frame member 26, a rod 28, an advertising track 30, and a carrier 68 configured to retain advertising panel 32 therein.

Frame member 26 is generally C-shaped in profile and includes a top wall 86, a rear wall 88, and a bottom wall 90. Top wall 86 defines top hole 34, rear wall 88 defines a rear hole 36, and bottom wall 90 defines a bottom hole 92. Bottom hole 92 is arranged parallel to top hole 34 but preferably is offset relative thereto to allow for the removable attachment of frame member 26 to flange 80 of beam 78 as will be described hereafter. Each of the top hole 34, rear hole 36, and bottom hole 92 is threaded. Both of the top hole 34 and bottom hole 92 are threaded to receive mounting bolt 38 therein. Rear hole 36 is threaded to receive bolt 42 therein. Bolt 38 has threads 40 to mate with one of top and bottom holes 34, 92 and bolt 42 has threads 44 to mate with rear hole 36.

Rod 28 may include a head 46 having a generally circular portion 47 with an opening 48 sized to receive bolt 42 therethrough. Rod 28 includes threads 50 arranged to be mated with a hole 52 in advertising track 30. Rod 28 is secured in a final position on track 30 with a lock nut 54 which may be any traditional type of nut and does not require a specific nylon stop of a lock nut. In the preferred embodiment, a pair of washers 56 is used in conjunction with bolt 42 to secure rod head 46 to frame member 26 via rear hole 36. Advertising track 30 is rotatable about rod 28 and therefore may be configured in a variety or orientations relative to frame member 26. Furthermore, when rod 28 is rotated in a first direction the circular portion 47 thereof moves closer toward an exterior surface of advertising track 30. When rod 28 is rotated in a second direction, the circular portion 47 thereof moves further away from the exterior surface of advertising track 30. Thus, the distance between advertising track 30 and rod 28, and therefore between track 30 and frame member 26 is adjustable by rotating rod 28 in either of the first and second directions.

In accordance with one of the main features of the invention, advertising track 30 preferably is generally tubular and has a chamber 58 which communicates with a longitudinally aligned slot 60 defined in track 30 opposite threaded hole 52. Advantageously, rod 28 can extend partially into chamber 58 of advertising track 30 to act as a locking mechanism for articles or devices that are disposed within chamber 58.

Advertising panel 32 preferably is composed of a sheet material, such as vinyl and may include a plurality of small holes therein that permit air to pass through panel 32 without damaging the material thereof. Although advertising panel 32 is shown and described as being composed of a vinyl material, any suitable material known in the art may be used without departing from the spirit and scope of the present invention as claimed. Advertising panel 32 has a top end, a bottom end, and first and second sides extending between the top and bottom ends. The sheet material of panel 32 is folded back upon itself at the top end and is secured in place by a seam 82 (FIG. 3) to form a ring 64. Ring 64 defines an inner bore 66 therein. The sheet material of panel 32 preferably is also folded back upon itself at the bottom end and is secured in place by a seam to form a second ring. Alternatively or additionally, the sheet material at one or both of the first and second sides is folded back upon itself and secured in place by a seam to form additional rings 64. The advertising panel 32 may therefore have one, two, three or four rings 64 around its perimeter. The area of the panel 32 disposed inwardly of these rings constitutes an advertising portion 62 upon which text and/or designs may be applied or incorporated.

In accordance with one of the main features of the invention, a carrier 68 is provided to engage ring 64. Carrier 68 preferably is generally tubular and defines an inner passage 70 which extends through the length of carrier 68. Unlike advertising track 30, inner passage 70 preferably does not include a slot, although one may be incorporated without departing from the spirit and scope of the present invention. Although carrier 68 is shown and described as being generally tubular, it will be understood that any other cross-sectional configuration may be utilized without departing from the spirit and scope of the present invention as claimed. Carrier 68 is received within bore 66 of ring 64 on advertising panel. An outer surface 72 of carrier 68 is disposed proximate an inner surface the ring 65 that defines bore 66. Carrier 68 and ring 64 are complementary shaped and sized to have a tight fit but the components preferably do not have an interference fit and, consequently, carrier 68 can be removed from bore 66 if desired.

Once carrier 68 is secured within bore 66, advertising track 30 is slidably engaged with ring 64 such that advertising portion 62 of panel 32 extends outwardly through slot 60 of advertising track 30. When this occurs, the outer surface 74 of ring 64 is located within chamber 58 of advertising track 30 and is disposed adjacent the interior surface of track 30 that defines chamber 58. Rod 28 is inserted into hole 52 and is rotated until the terminal end 76 of rod 28 contacts outer surface 74 of ring 64 and locks the same within advertising track 30. Thus, advertising panel 32 extends outwardly from and is securely retained by advertising track 30.

Figure 3:
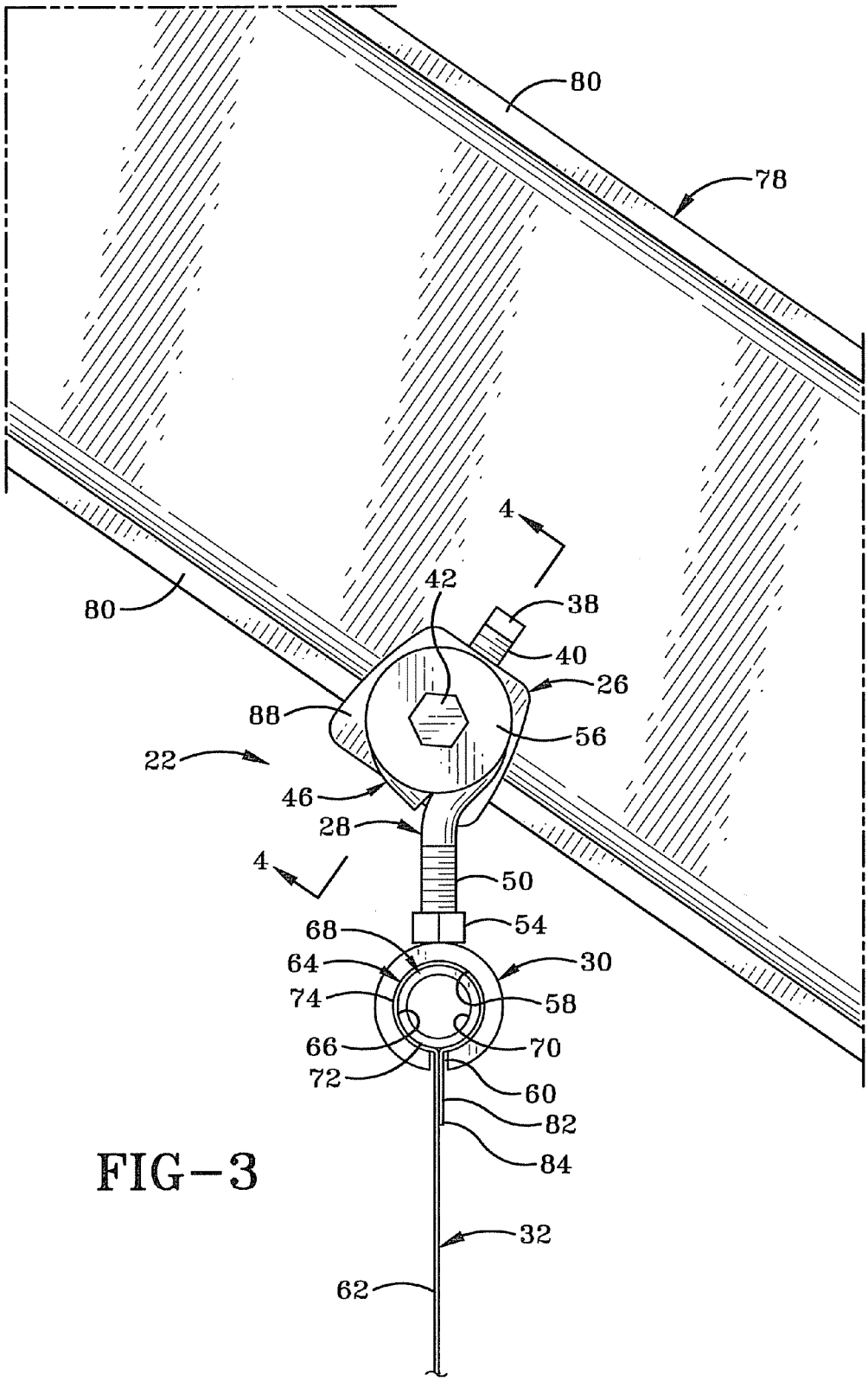
FIG. 3 is a left side elevational view of the panel fastening assembly showing a frame member secured to a beam.
Figure 4:
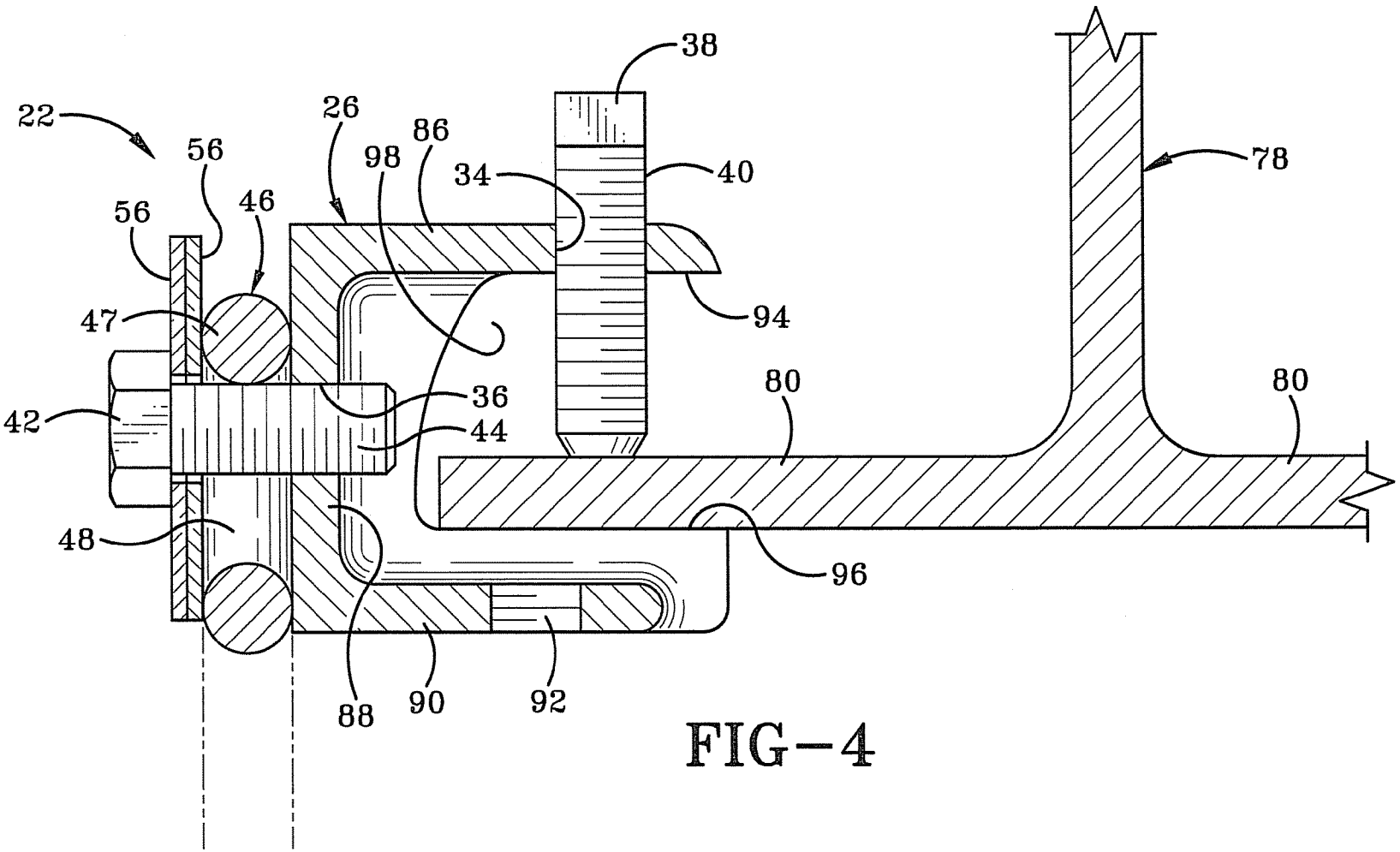
FIG. 4 is a cross-sectional view taken through line 4-4 of FIG. 3.

Referring to FIGS. 3 & 4, panel fastening assembly 22 is shown secured to a beam 78, such as the type of beam that would be present on a bleacher. Beam 78 is illustrated as being disposed at an angle to the vertical. Specifically, beam 78 may be a top rail beam arranged at an angle similar to a bleacher seating surface. Beam 78 preferably is an I-beam that includes a web having a flange 80 at the top and bottom ends of the web. As will be discussed in greater detail below, frame member 26 is arranged to be secured to one of these flanges 80. FIG. 2 shows that advertising panel 32 includes a ring 64 disposed along at least one edge. FIG. 3 shows that ring 64 is formed by folding a terminal edge of panel 32 back onto a section of panel 32 and creating a seam 82 therein. Thus, ring 64 and panel 32 are made from the same sheet material. It will be understood, however, that ring 64 may be made from a different material to panel 32 simply by securing a section of the different material to panel 32 by way of a seam. If panel 32 does not require the panel fastening assembly to be secured to a particular side of panel 32, then a ring 64 would not be formed along that side or the ring could be formed and simply not be used.

FIG. 4 illustrates an enlarged cross sectional view of panel fastening assembly 22 secured to beam 78, and to flange 80 of that beam 78, in particular. Specifically, the installer of the advertising panel system may use either of the top and bottom holes 34, 92 to secure frame member 26 to flange 80. Frame member 26 also includes an inner surface 94 of top wall 86, and an inner surface 96 of bottom wall 90. A cavity 98 is defined between inner surface 94 and inner surface 96. Each of inner surfaces 94, 96 are adapted to abut flange 80, depending on whether top hole 34 or bottom hole 92 are used to locate flange 80 within cavity 98. Specifically, bolt 38 is threaded through either top hole 34 or bottom hole 92 to engage flange 80 and thereby wedge or secure frame member 26 in abutting contact with flange 80. While the first preferred embodiment frame is shown with the inner surfaces 94, 96 being generally disposed at right angles relative to rear wall 88, flat, it is within the spirit and scope of the present invention to incline the inner surface 94 and/or the inner surface 96 relative to rear wall 88 to match the angle of flange 80 as necessary.

Having described the structure of the first preferred embodiment, a preferred method of operation will be described in detail and should be read in light of FIGS. 1 through 4. Advertising panel 32 is formed with seam 82 defining ring 64 which has inner bore 66. Carrier 68 is inserted into inner bore 66 of ring 64 and the combination thereof is inserted into chamber 58 of advertising track 30. Specifically, ring 64 is positioned within track 30 such that the advertising portion 62 of panel 32 is aligned with slot 60 in track 30 and extends outwardly therefrom.

Bolt 38 is threaded through either of top hole 34 or bottom hole 92 of frame member 26, depending on which side of the beam is most easily accessed. Frame member 26 is then positioned so that flange 80 extends into cavity 98. Bolt 38 is rotated until either inner surface 94 of top wall 86 abuts the upper surface of flange 80 or inner surface 96 of bottom wall 90 engages the bottom surface of flange 80. Bolt 38 is tightened to the point that frame member 26 cannot be pulled out of engagement with flange 80. Nut 54 may either be threadably engaged with threads 50 on the shaft of rod 28 and rotated upwardly until a portion of the tip 76 thereof extends outwardly beyond nut 54 or nut 54 may be mounted on the outer surface of track 30 adjacent hole 52 and the threaded shaft of rod 28 is screwed through into nut 54 and into hole 52.

Nut 54 is rotated to thread a length of rod 28 downwardly into chamber 58 of track 30. When a sufficient length of the shaft of rod 28 is received in chamber 58, the tip 76 will engage the exterior surface of the combined ring 64 and carrier 68 and will lock the same in place within track 30. Rod 28 is secured to frame member 26 by inserting bolt 42 through washers 56, through opening 48 and into rear hole 36 in rear wall 88 of frame member 26. Bolt 42 is rotated until rod 28 is tightly retained against rear wall 88 of frame member 26. Thus, track 30 and advertising panel 32 are securely locked to frame member 26. Frame member 26 is then secured to beam 78 as previously described.

In a similar fashion, a second advertising track (not shown) and second frame member (not shown) may be secured to an opposite end of advertising panel 32 from that shown in FIG. 1. The second frame member may also be secured to a second beam that is spaced a distance from beam 78. When the two frame members are secured to the two beams and the rods 28 of the two panel fastening assemblies retain advertising panel 32 in the two opposing tracks 30 thereof, then the advertising panel 32 is tensioned between the two panel fastening assemblies and the graphics and text of any advertising displayed on panel 32 is clearly visible.

Having described the structure and operation of the first preferred embodiment, only those portions of the second embodiment which are different from the first embodiment are described in detail. Likewise, similar numerals refer to similar parts throughout the various embodiments.

Figure 5:
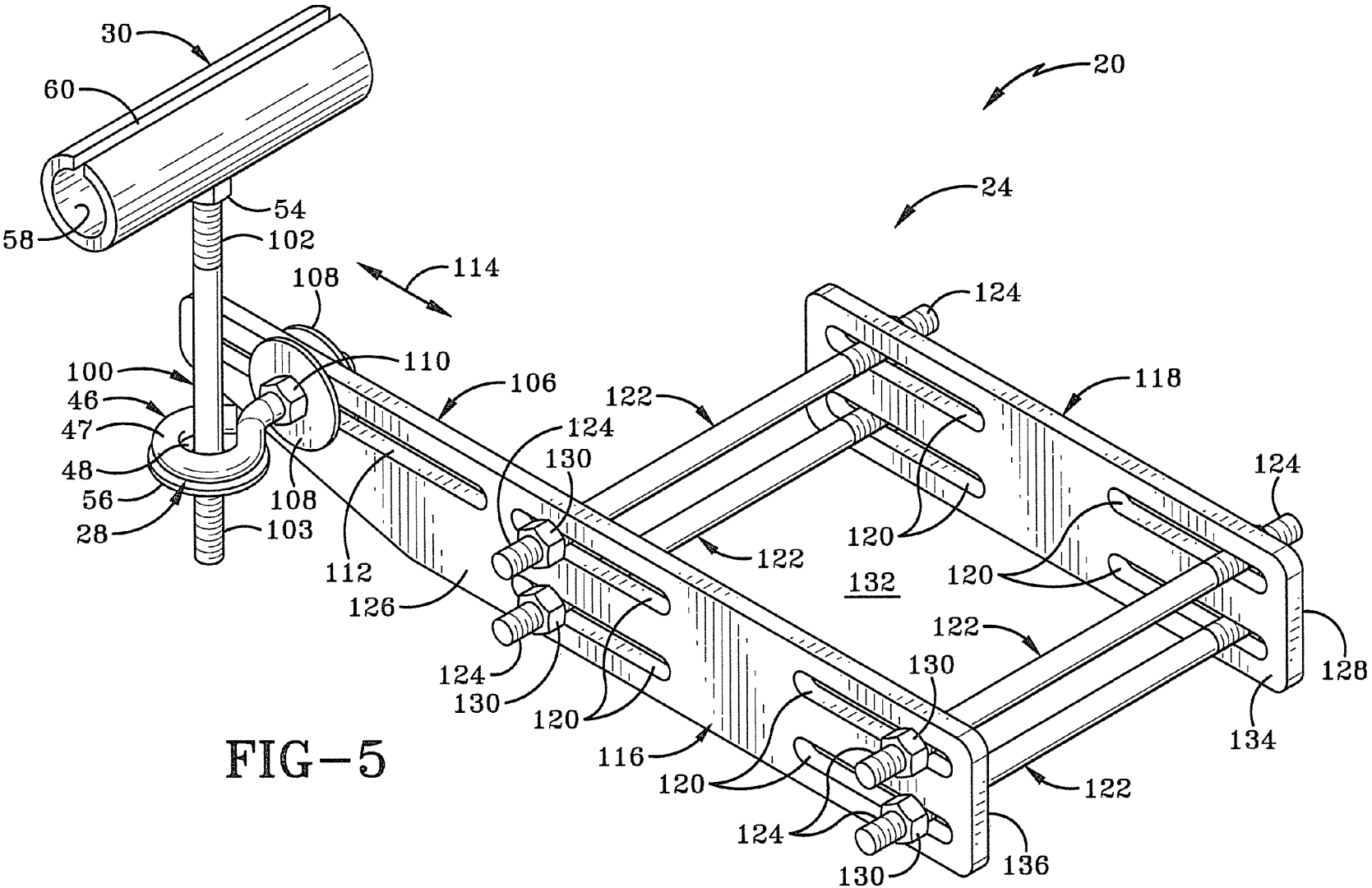
FIG. 5 is a perspective view of a second preferred embodiment of a panel fastening assembly for use in the advertising display system in accordance with the present invention shown prior to installation on a beam.
Figure 6:
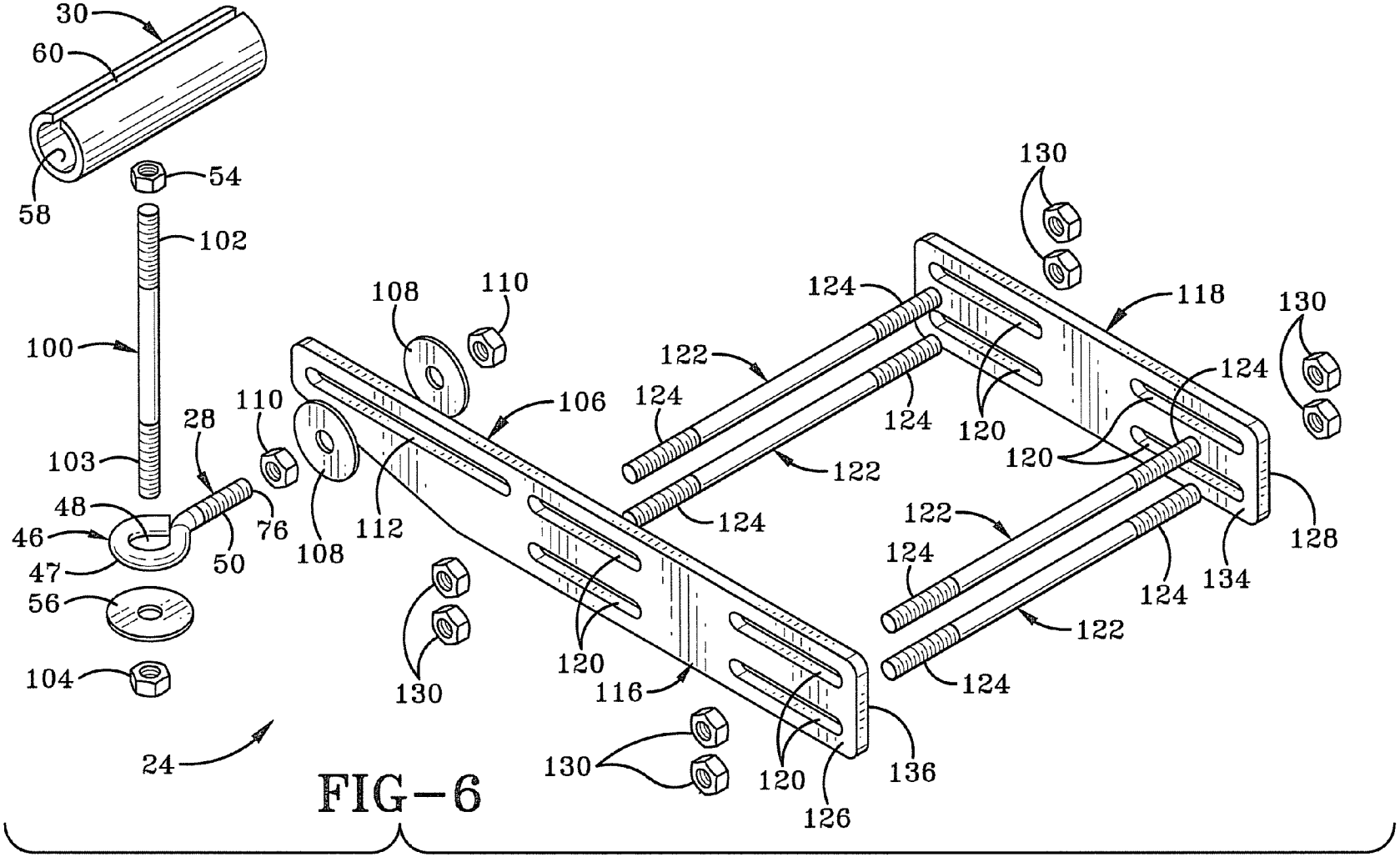
FIG. 6 is an exploded view of the panel fastening assembly of FIG. 5.

FIGS. 5 through 11 illustrate a second preferred embodiment of a panel fastening assembly in accordance with the present invention and generally referenced by the number 24. Referring specifically to FIGS. 5 and 6 and in accordance with another main feature of the invention, advertising track 30 and rod 28 are similar to the panel fastening assembly 22, but panel fastening assembly 24 further includes a second rod 100 that engages rod 28 and track 30 and is operable to vary the distance between the same. Rod 100 includes a threaded portion 102 at a first end and a threaded portion 103 at a second end. Threaded portion 102 is engaged with track 30 and lock nut 54 is used to secure that first end of rod 100 to track 30 in a similar manner as bolt 42 is secured to rod 28 in panel fastening assembly 22. Threaded portion 103 of rod 100 is received through opening 48 of rod 28, and a washer 56 and nut 104 (FIG. 6) are used to vary the distance between track 30 and rod 28, as will be described hereinafter.

Figure 7:
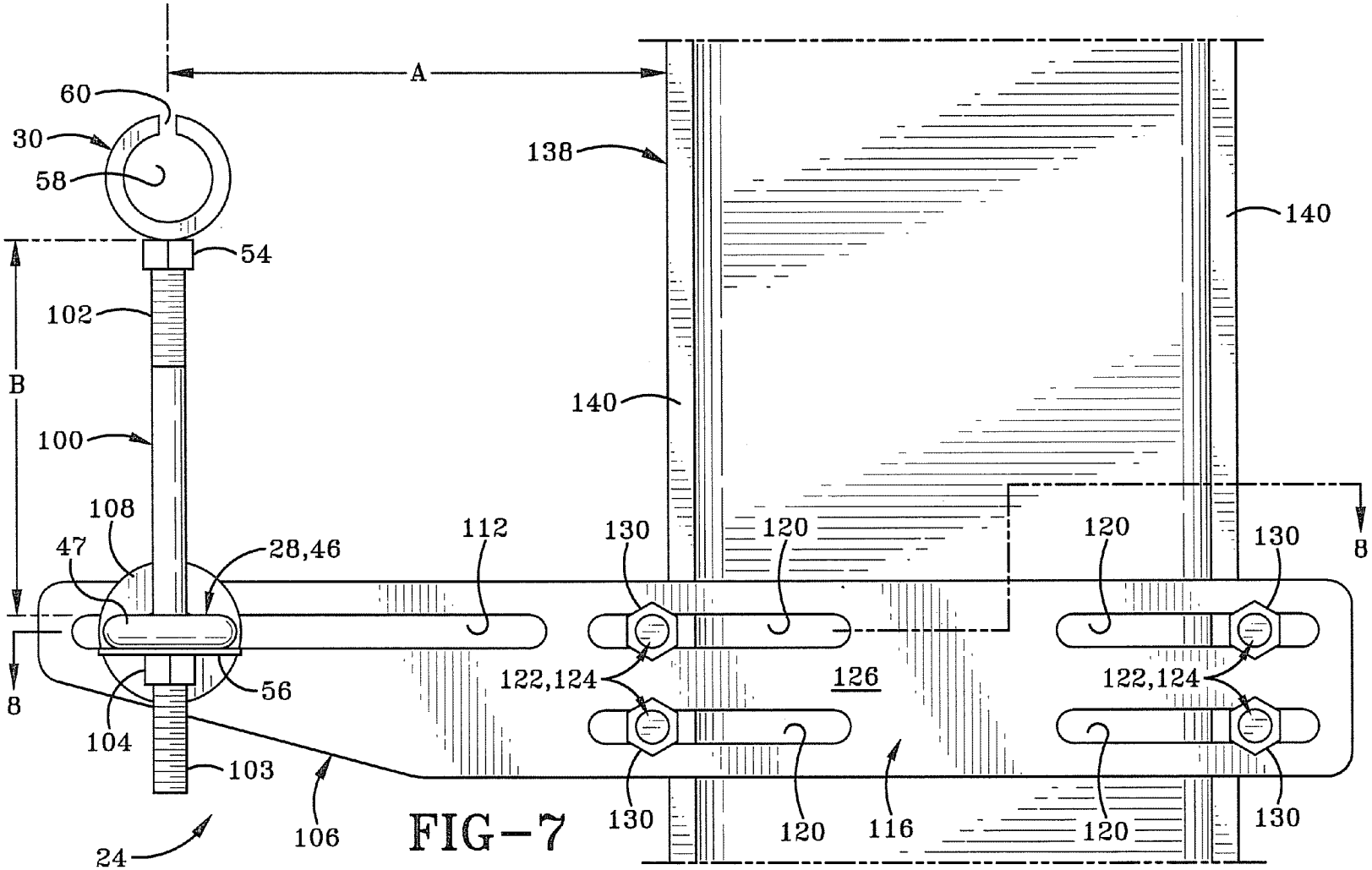
FIG. 7 is a front elevational view of the panel fastening assembly shown secured to a beam.

Panel fastening assembly 24 further includes a frame member 126 which is removably secured to a beam 138 (FIG. 7). Frame member 126 comprises a first arm 106 and a second arm 118 that are connected to each other by way of a plurality of mounting bolts 122. Rod 28 is secured to first arm 106 with a pair of washers 108 and a pair of nuts 110. Specifically, rod 28 is inserted through an elongated slot 112 in first arm 106 and nuts 110 lock the same in position. The position of rod 28 in slot 112 is adjustable as indicated by the arrows 114. In order to move rod 28 in slot 112, nuts 110 are loosened and rod 28 is slid to the desired location. Nuts 110 are then tightened to lock rod 28 in place. Thus, the position of rod 100 and, therefore the advertising track 30 is adjustable along the length of elongated slot 112. This enables the installer to locate the advertising panel (not shown in these figures) at a predetermined location relative to the beam 138.

In accordance with another feature of the present invention, first arm 106 includes a rear portion 116 that is complementary in shape and size to second arm 118. Both of the rear portion 116 and second arm 118 include a plurality of elongated slots 120. The slots 120 on rear portion 116 are aligned with the slots on second arm 118. In the preferred embodiment, four elongated slots 120 are defined in rear portion 116 and four elongated slots 120 are defined in second arm 118. Four mounting bolts 122 are provided to secure first arm 106 and second arm 118 together. Each mounting bolt 122 preferably includes a threaded portion 124 at each end and when bolts 122 are engaged through slots 120 in first and second arms 106, 118, the threaded portion 124 extends beyond the outer surfaces 126, 128 of rear portion 116 and second arm 118, respectively. Nuts 130 are engaged with mounting bolts 122 and abut outer surfaces 126, 128. Once first and second arms 106, 118 are secured together with mounting bolts 122, a cavity 132 is defined by an inner surface 134 of second arm 118, an inner surface 136 of rear portion 116 of first arm 106, and mounting bolts 122. Since slots 120 are elongated longitudinally, the longitudinal position of mounting bolts 122 may be varied as necessary to secure frame member 126 to beam 138, as will be hereinafter described.

Figure 8:
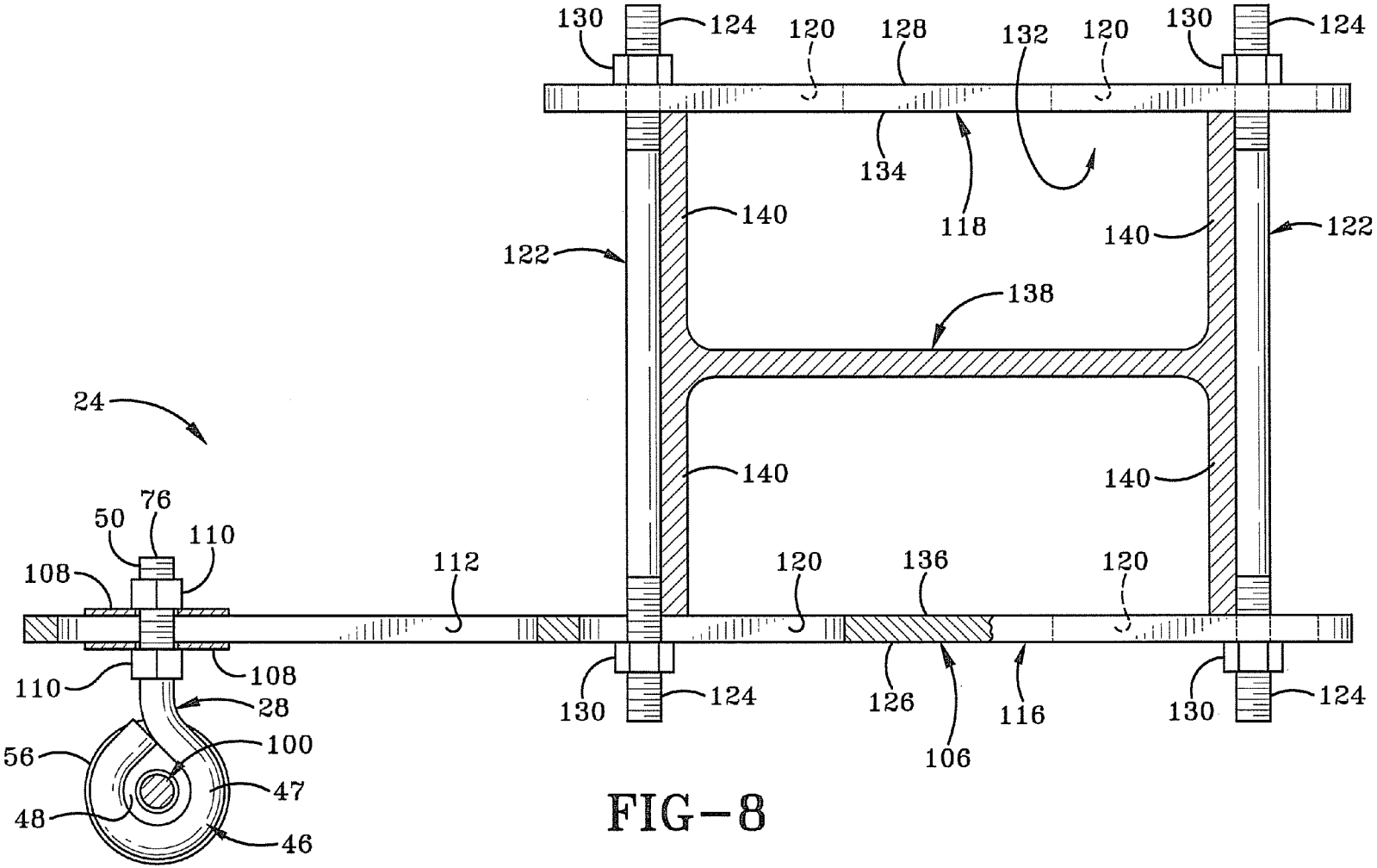
FIG. 8 is a partial cross-sectional view taken generally along line 8-8 in FIG. 7.

FIGS. 7 and 8 illustrate panel fastening assembly 24 secured around a vertical beam 138. Vertical beam 138 is an I-beam having a central web with flanges 140 at either end. Frame member 126 is engaged with beam 138 in such a manner that inner surface 136 of first arm 106 abuts the terminal ends of the flanges 140 on a first side of the web and inner surface 134 of second arm 118 abuts the terminal ends of the flanges 140 on a second side of the web. Mounting bolts 122 are adjusted within slots 120 of first and second arms 106, 118 such that a first pair of bolts 122 are disposed in abutting contact along the length of a first one of the flanges 140 and a second pair of bolts 122 are disposed in abutting contact along the length of a second one of the flanges. Nuts 130 are tightened to secure frame member 126 in place on beam 138. It will be understood that frame member 126 could be rotated through ninety degrees from the manner illustrated in FIGS. 7 & 8. In this second instance, inner surface 136 of first arm 106 would abut the length of the first one of the flanges 140 and inner surface 134 of second arm 118 would abut the length of the second one of the flanges 140. Mounting bolts 122 would engage the terminal ends of the flanges 140. In either event, beam 138 is circumscribed by frame member 126 and frame member 126 is tightly locked into position along the vertical length of the beam 138 by the cooperating nuts 130 and bolts 122. Advantageously, because mounting bolts 122 are secured with elongated slots 120, panel fastening assembly 24 can easily fit beams of various sizes.

FIGS. 7 and 8 further illustrate that the position of advertising track 30 relative to beam 138 may also be offset as desired. The distance between track 30 and beam 138 is indicated by the dimension "A" (FIG. 7). As will be evident, dimension "A" may be adjusted by sliding rod 28 along slot 112 toward or away from beam. This offset can be useful if the beam is spaced further apart from an upper beam or other attachment mechanism for the panel fastening assembly, as well as any overhanging objects that the advertising panel may cover.

The distance, between advertising track 30 and frame member 126 is indicated by the dimension "B". As will be evident, dimension "B" may be adjusted by rotating nuts 54, 104 to change the length of the section of bolt 100 that extends between track 30 and rod 28. FIG. 7 illustrates the panel fastening assembly 24 in the lower mounting position. This arrangement is used for securing the bottom edge of the advertising panel (not shown). The height of advertising track 30 and the tension within the advertising panel 32 are adjusted by either tightening or loosening nut 104 on lower threaded portion 102 of the rod 100 and then extending or shortening the section of rod 100 between track 30 and rod 28.

Figure 9:
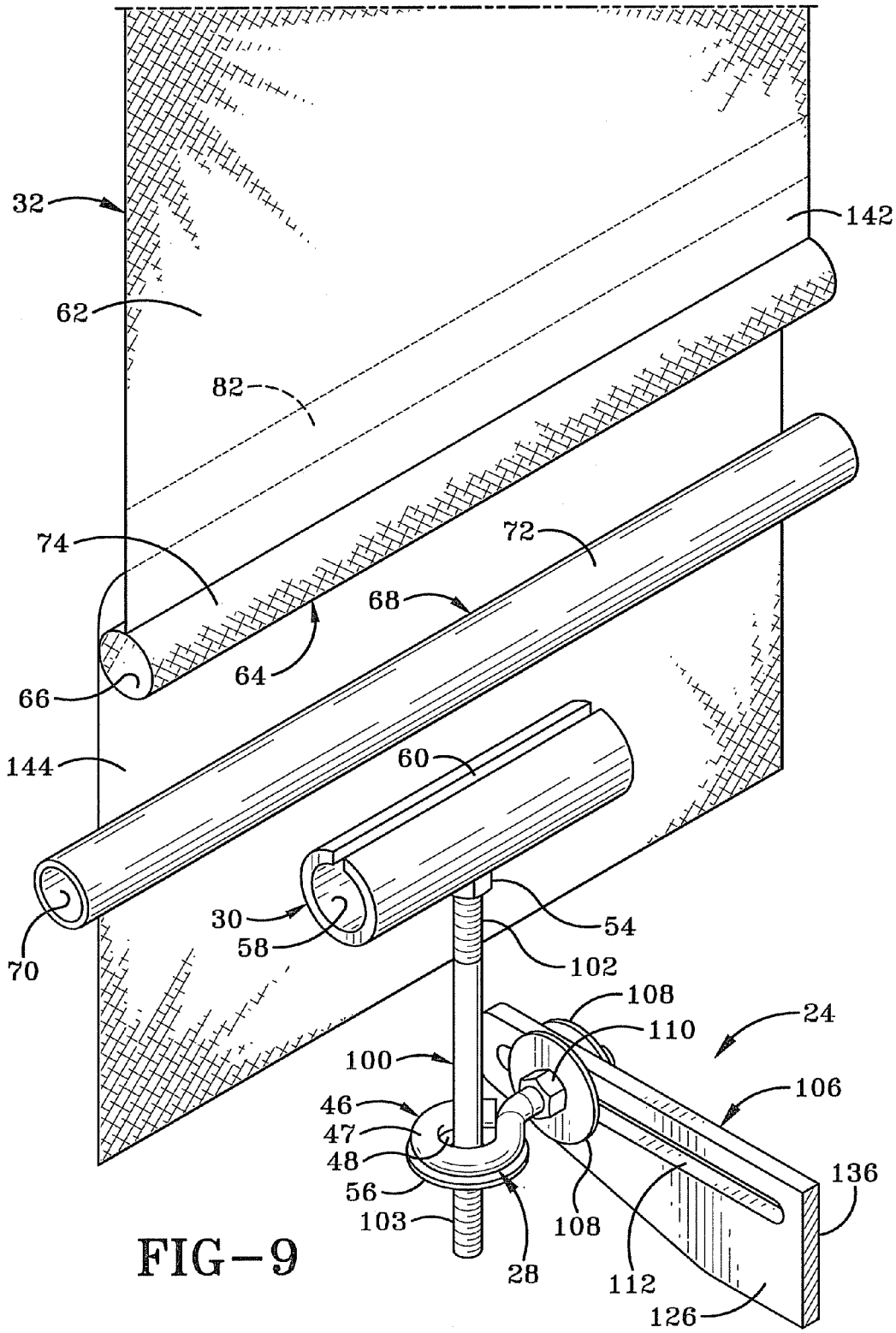
FIG. 9 is a partially exploded view of the panel fastening assembly with the carrier shown separated from the frame member and the advertising panel.
Figure 10:
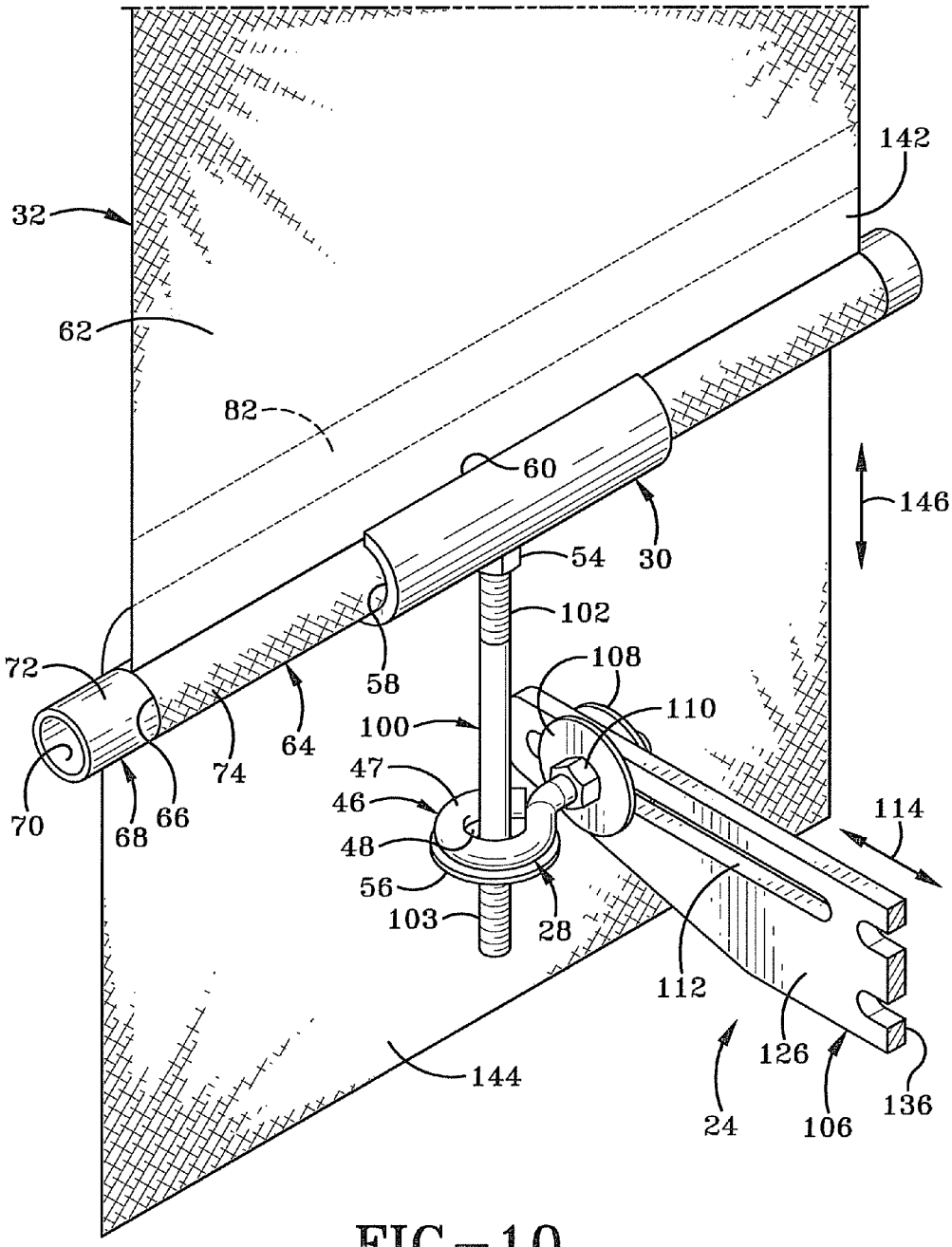
FIG. 10 is a perspective rear view of the panel fastening assembly retaining an advertising panel therein and showing the adjustability of the frame member.

The securement of a bottom end of an advertising panel 32 with panel fastening assembly 24 is illustrated in FIGS. 9 and 10. Advertising panel 32 includes an advertising portion 62 and has a seam 82 formed along its lower end 142. Seam 82 secures a folded region of the lower end of panel 32 back on itself to form ring 64. Additionally, a skirt portion 144 of panel 62 is secured to advertising portion 62 along seam 82. Ring 64 formed on lower end 142 of advertising portion 62 has an outer surface 74 and defines an inner bore 66. As was the case with the first preferred embodiment of the invention, carrier 68 is inserted into inner bore 66 of ring 64 in such a manner that the outer surface 72 of carrier 68 abuts an interior surface of ring 64. Carrier 68 defines a passage 70 therein. The combined carrier 68 and advertising panel 32 are engaged within chamber 58 of advertising track 30 as described with reference to the first preferred embodiment. Consequently, when track 30 is so engaged, advertising portion 62 of panel 32 extends outwardly and upwardly through slot 60 of track 30. Skirt panel 144 hands downwardly from lower end 142 of panel 62 and effectively hides all the components of panel fastening assembly 24 from view. Nut 54 is rotated to lock the combined carrier 68 and panel 32 to advertising track 30.

FIG. 10 illustrates advertising panel 32 engaged with panel fastening assembly 24. Although not illustrated herein, it will be understood that beam 138 is disposed substantially parallel to advertising panel 32 and surrounded by the rear portion 116 of first arm 106 and second arm 118 (not shown in this figure) of frame member 126. It should be noted that when panel fastening assembly 24 is being used to secure advertising panel 32 to a beam, the frame member 126 is positioned vertically beneath advertising track 30. Advertising panel 32 may be drawn closer to the beam or moved further away therefrom by longitudinally adjusting the position of rod 28 in slot 112, as indicated by arrows 114. Additionally, the tension in advertising panel 32 may be adjusted in the directed indicated by arrows 146. The tension is adjusted by changing the relative distance between track 30 and rod 28 by rotating the nut 104 (not shown in these figures) as described with reference to the first preferred embodiment of the invention. Ideally, the tension is adjusted until the advertising panel 32 is pulled substantially taut and free of wrinkles.

Figure 11:
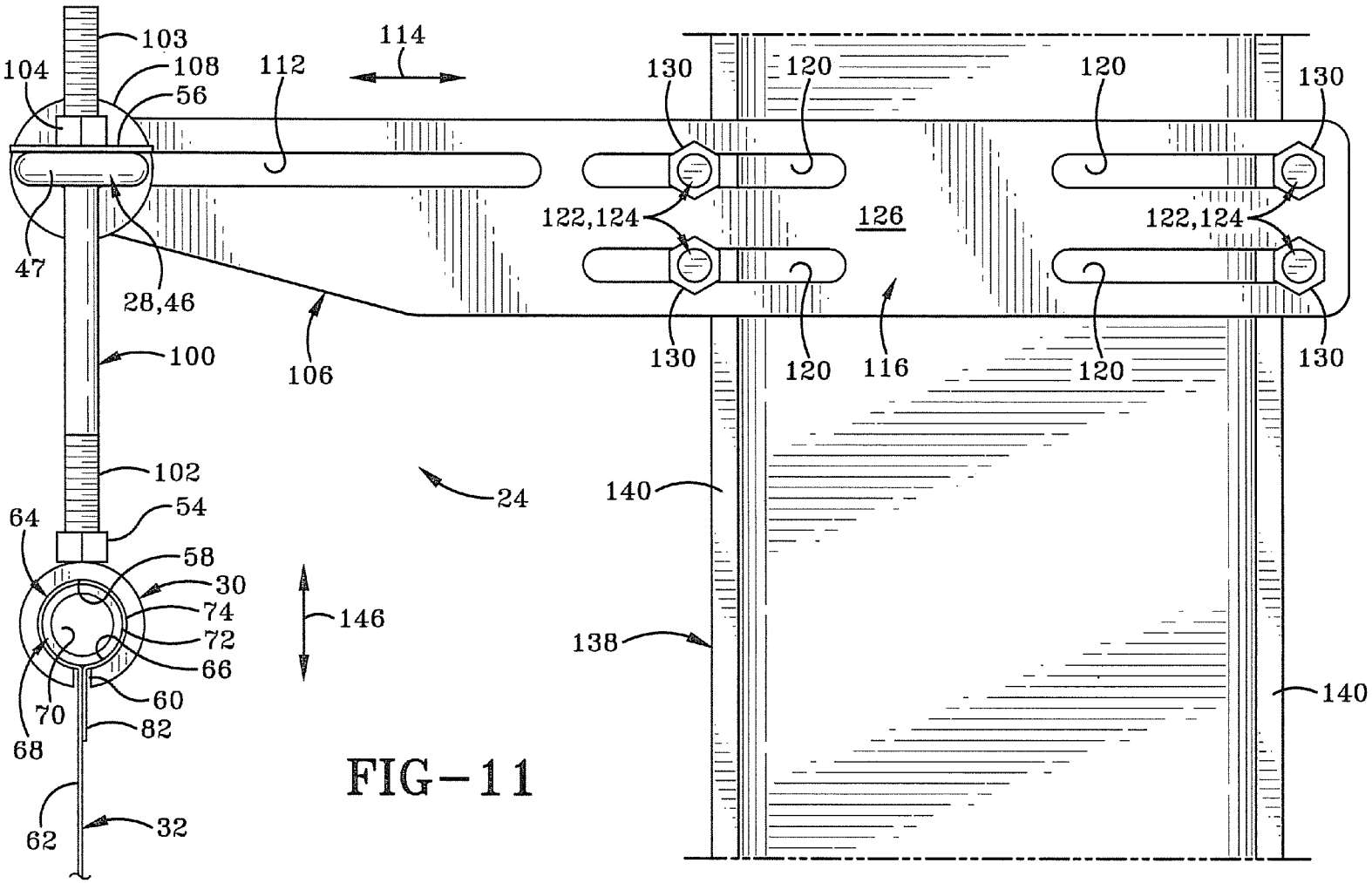
FIG. 11 is a right side elevational view of the panel fastening assembly installed on the beam.

FIG. 11 illustrates panel fastening assembly 24 arranged to secure the top end of advertising panel 32 to the vertical beam 138. In this instance, frame member 126 is positioned vertically above advertising track 30 and advertising panel 32 hangs downwardly from advertising track 30. As was the case with respect to FIGS. 9 & 10, this relative distance between panel 32 and beam 138 is adjusted by sliding rod 28 horizontally along slot 112 in the directions indicated by arrow 114. The vertical distance of advertising panel 32 from frame member 126 is adjusted by rotating nut 104 to effectively lengthen or shorten rod 100 in the directions indicated by the arrows 146. Thus the operator can adjust the tension in the advertising panel 32 by rotating nut 104.

Having described the structure of the second preferred embodiment of the panel fastening assembly 24 in accordance with the present invention, a preferred method of operation will be described in detail and should be read in light of FIGS. 5 through 11. Due to the fact that advertising panel 32 remains virtually identical within both of the first and second preferred embodiments of the invention, with the addition of skirt panel 144 (which does not change the operation of the panel fastening assembly), the attachment of the advertising panel 32 to the advertising track 30 will not be described again as it is identical to that discussed above. Further, the manner of tensioning and positioning of the second preferred embodiment is substantially identical to the first preferred embodiment.

Panel fastening assembly 24 is secured to beam 138 in the following manner. First arm 106 and second arm 118 are arranged on opposite sides of vertical beam 138 and the plurality of mounting bolts 122 are inserted through elongated slots 120. Mounting bolts 122 are secured in place around vertical beam 138 with nuts 130 to form a cavity 132. Vertical beam 138 is retained within this cavity 132. Rod 28 is inserted into elongated slot 112 in first arm 106 and washers 56 and nuts 110 are finger tightened. The position of rod 28 in slot 112 is adjusted and then nuts 110 are rotated to lock rod 28 against further movement in slot 112. Rod 100 is inserted through opening 48 in rod 28. Nut 104 is rotated to adjust the position between track 30 and rod 28. Nut 104 is rotated in a first direction to decrease the distance between track 30 and rod 28 and thereby increase the tension on panel 32. Nut 104 is rotated in a second direction to increase the distance between track 30 and rod and thereby decrease the tension on panel 32. The remainder of the installation is similar to that of the first preferred embodiment. Once again, carrier 68 is inserted within inner bore 66 of ring 64 and the combination is then engaged within advertising track 30 such that advertising portion 62 extends outwardly through slot 60 of track 30. In the installation of track 30 at the bottom end of advertising panel 32, skirt panel 144 hangs downwardly to hide ring 64 and frame member 26.

Having described the structure and operation of the two preferred embodiment panel fastening assemblies 22, 24, a preferred embodiment of an advertising display system where one or both of these panel fastening assemblies is utilized will now be described in detail. Similar numerals refer to similar parts throughout the various embodiments.

Figure 12:
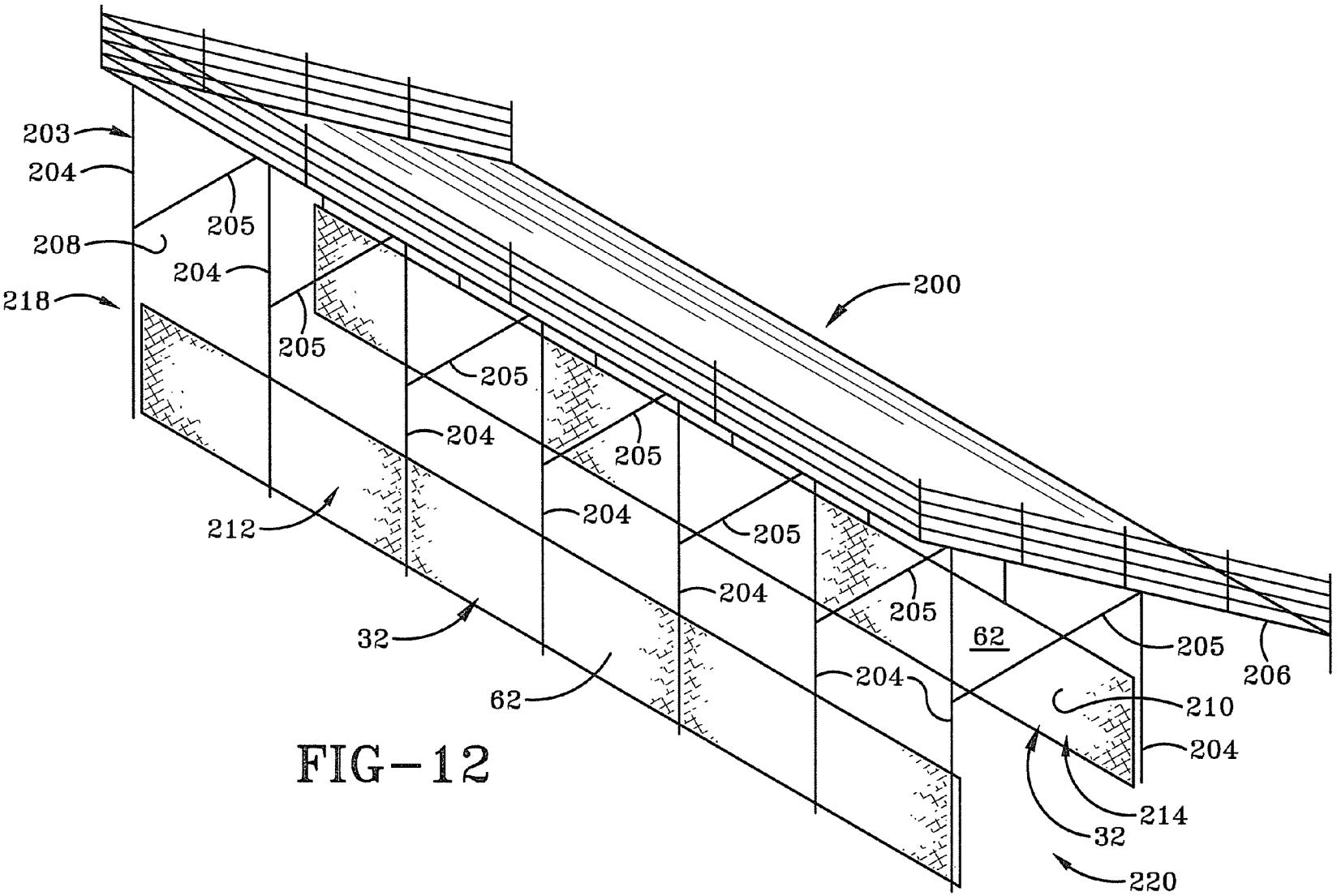
FIG. 12 is a perspective rear view of the advertising display system in accordance with the present invention showing the bleacher with the advertising panel assembly mounted thereon.
Figure 13:
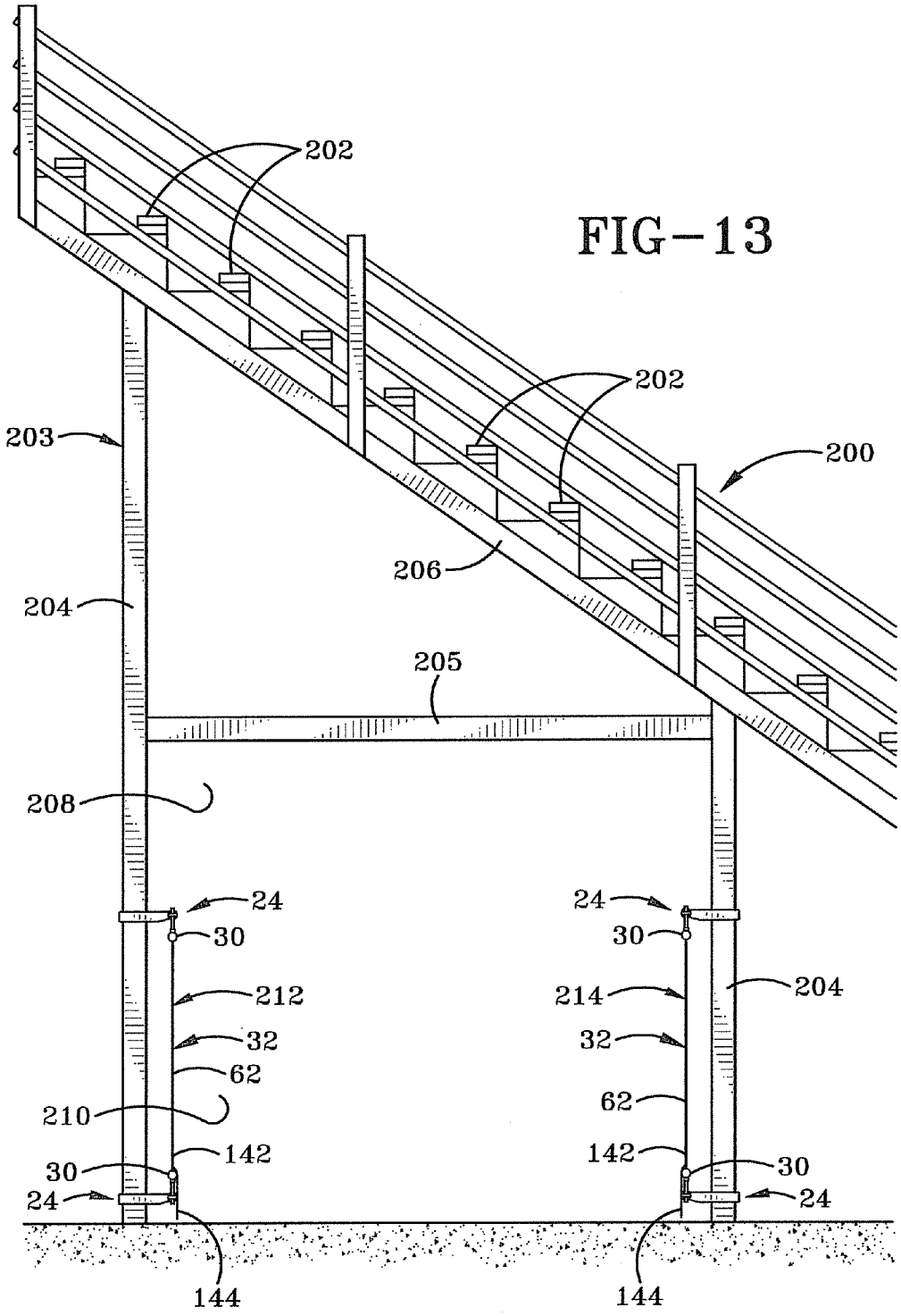
FIG. 13 is a right side elevational view of the advertising display system of FIG. 12 showing the bleacher with the first and second advertising panels mounted within the primary chamber.

FIGS. 12 and 13 illustrate an advertising display system in which an advertising panel assembly, including one or both of the panel fastening assemblies 22, 24, is utilized in conjunction with a bleacher 200. Bleacher 200 (FIG. 13) has a seating surface 202 that is supported on a scaffold structure 203 comprised of a plurality of vertical beams 204, horizontal beams 206 and angled beams 206. Bleacher has a front portion and a rear portion and seating surface 202 extends between the front and rear portions. Rear portion is vertically higher than front portion and, consequently, seating surface 202 angles downwardly from rear portion toward front portion. Although not specifically illustrated in the figures, seating surface 202 includes a plurality of seats.

The support beams 204, 205, 206 and an underside of seating surface 202 define a primary chamber 208 that is effectively positioned beneath seating surface 202 and the ground upon which bleacher 200 sits. The perimeter of primary chamber 208 is defined by the outermost support beams. Furthermore, the support beams 204, 205, 206 define a first and a second longitudinal side of primary chamber 208 such that primary chamber 208 is of a sufficient height and width so as to permit foot traffic and spectators to pass therethrough. Preferably, primary chamber 208 is at least seven feet high and has a length that extends from a first end 218 of the bleacher 200 to a second end 220 thereof.

Disposed within primary chamber 208 is a secondary chamber 210 formed by utilizing an advertising panel assembly. The advertising panel assembly includes a plurality of advertising panels 32 and a plurality of panel fastener assemblies 22 or 24. The advertising panel assembly preferably is comprised of at least two advertising panels 32 which are mounted by way of panel fastening assemblies 22, 24 to a plurality of the support beams 204, 205, 206. Furthermore, the advertising panel assembly is mounted on both of the first and second longitudinal sides of bleacher 200. As illustrated in FIG. 12, panels 32 extend from first end 218 of bleacher 200 to a second end 220 thereof. Advertising panels 32 are mounted to vertical beams 204 by way of a plurality of panel fastening assemblies 22 or 24. Since beams 204 are vertical, preferably a plurality of panel fastening assemblies 24 are used to secure advertising panels 32 to beams 204, although panel fastening assemblies 22 could be used for this purpose. Panel fastening assemblies 24 are secured to beams 204 at intervals along the length of primary chamber 208. More specifically, a plurality of panel fastening assemblies are provided at the top of primary chamber 208, i.e., at a height remote from the ground, and a plurality of panel fastening assemblies are provided at the bottom of the primary chamber 208, i.e., at a height closer to the ground. This is illustrated in FIG. 13. Still further, the preferred embodiment incorporates a first advertising panel 212 positioned at the rear of the primary chamber 208 and a second advertising panel 214 at the front of the primary chamber 208, with each of the first and second advertising panels 212, 214 being secured to beams 204 by the plurality of panel fastening assemblies 22, 24.

In this arrangement, advertising provided on advertising panels 32 will be visible on first and second advertising panels 212, 214 as they form the left and right hand sides of a secondary chamber disposed in the primary chamber 208. First and second advertising panels 212, 214 form a tunnel that spectators may walk through to pass underneath bleacher 200 and advertising may therefore be seen on both interior walls of the tunnel and on the exterior surface of the first advertising panel 212. Advantageously, this arrangement improves the aesthetic appearance of bleacher 200, as well as potentially generating revenue for the stadium or arena owner from the advertising displayed on advertising panels 32.

While the invention is described as being used in a primary chamber 208 where spectators are able to walk through the chamber, a smaller version of the preferred embodiment of the invention may be utilized in smaller locations, such as to define a storage chamber, for example.

Figure 14:
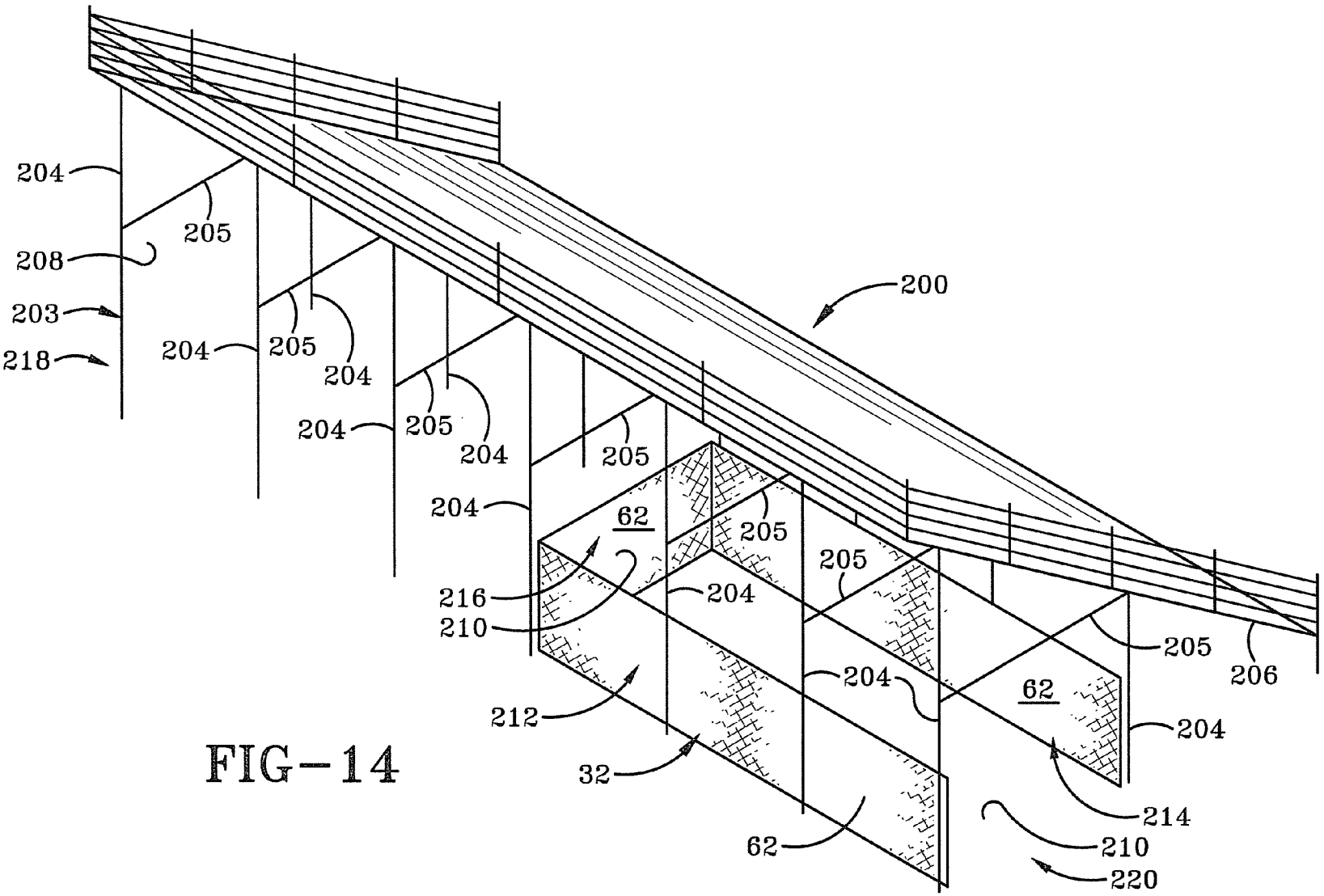
FIG. 14 is a perspective view of a second preferred embodiment of the advertising display system in accordance with the present invention showing an advertising tunnel formed by the first and second advertising panels and having an intermediate panel defining a terminal end of the tunnel.
Figure 15:
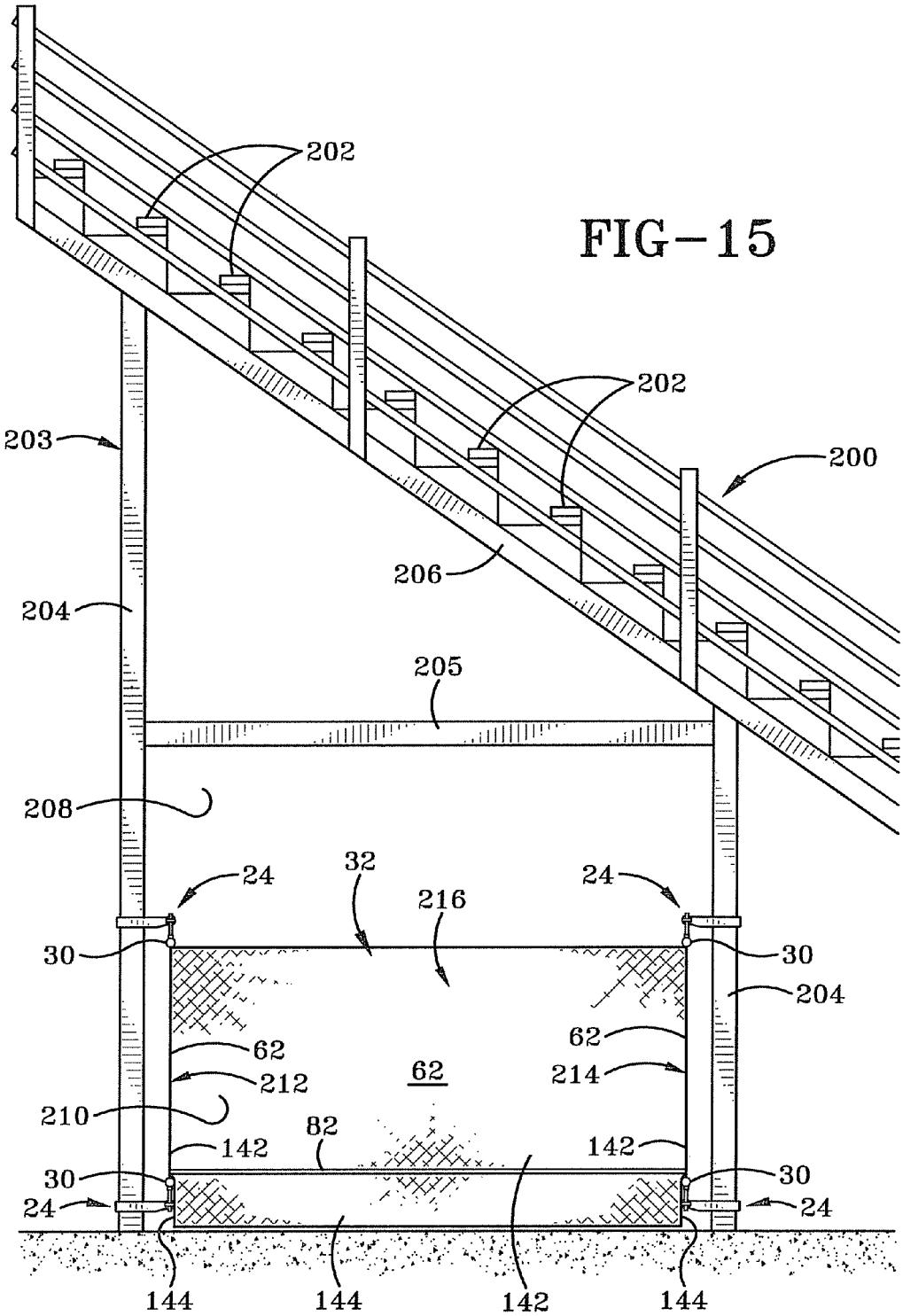
FIG. 15 is a right side elevational view of the advertising display system of FIG. 14.

In accordance with another feature of the present invention, FIGS. 14 and 15 disclose a second embodiment of the advertising display system in accordance with the present invention. In this second embodiment, primary chamber 208 has a first end 218 opposite a second end 220, and has a longitudinal axis extending between first and second ends 218, 22. The advertising display system further includes an intermediate advertising panel 216 that is disposed at an angle to the longitudinal axis of the primary chamber 208. Preferably, intermediate panel 216 is oriented substantially perpendicular to the longitudinal axis of primary chamber 208 and extends perpendicularly between panels 212 and 214. Intermediate panel 216 preferably is of the same height as first and second advertising panels 212, 214. The tunnel so formed therefore has a terminal end provided by intermediate panel 216. This type of arrangement may also be utilized if it is desired to create a smaller vending area under the bleacher 200. Advantageously, this arrangement allows advertising to be displayed on the inner and outer surfaces of first advertising panel 212, and the inner surfaces of second advertising panel 214 and intermediate panel 216. The advertising on the intermediate panel 216 will be extremely visible as spectators will walk toward the advertising. This type of arrangement could be utilized where an entrance to the seating area 202 of bleacher 200 is accessible somewhere between the first and second ends of the bleacher 200. In this instance, a section of panel 214 that is aligned with the access point to the seating will need to be omitted from that panel 214. Similar to the first embodiment of the advertising tunnel, a plurality of panel fastening assemblies 24 are used to attach the panels 212, 214, 216 of the advertising tunnel to support beams 204.

It should be noted that while the intermediate panel 216 preferably extends perpendicularly between first and second advertising panels 212, 214, a frame fastening assembly 22 may be utilized instead of panel fastening assembly 24 so as to orient intermediate panel 216 at an angle of other than ninety degrees to first and second advertising panels 212, 214. This may be accomplished by rotating advertising track 30 out of vertical alignment with frame member 26. Then, when frame member 26 is secured to beam, the rotated track 30 will retain the advertising panel 32 at the rotated angle relative to the first and second advertising panels 212, 214.

Figure 16:
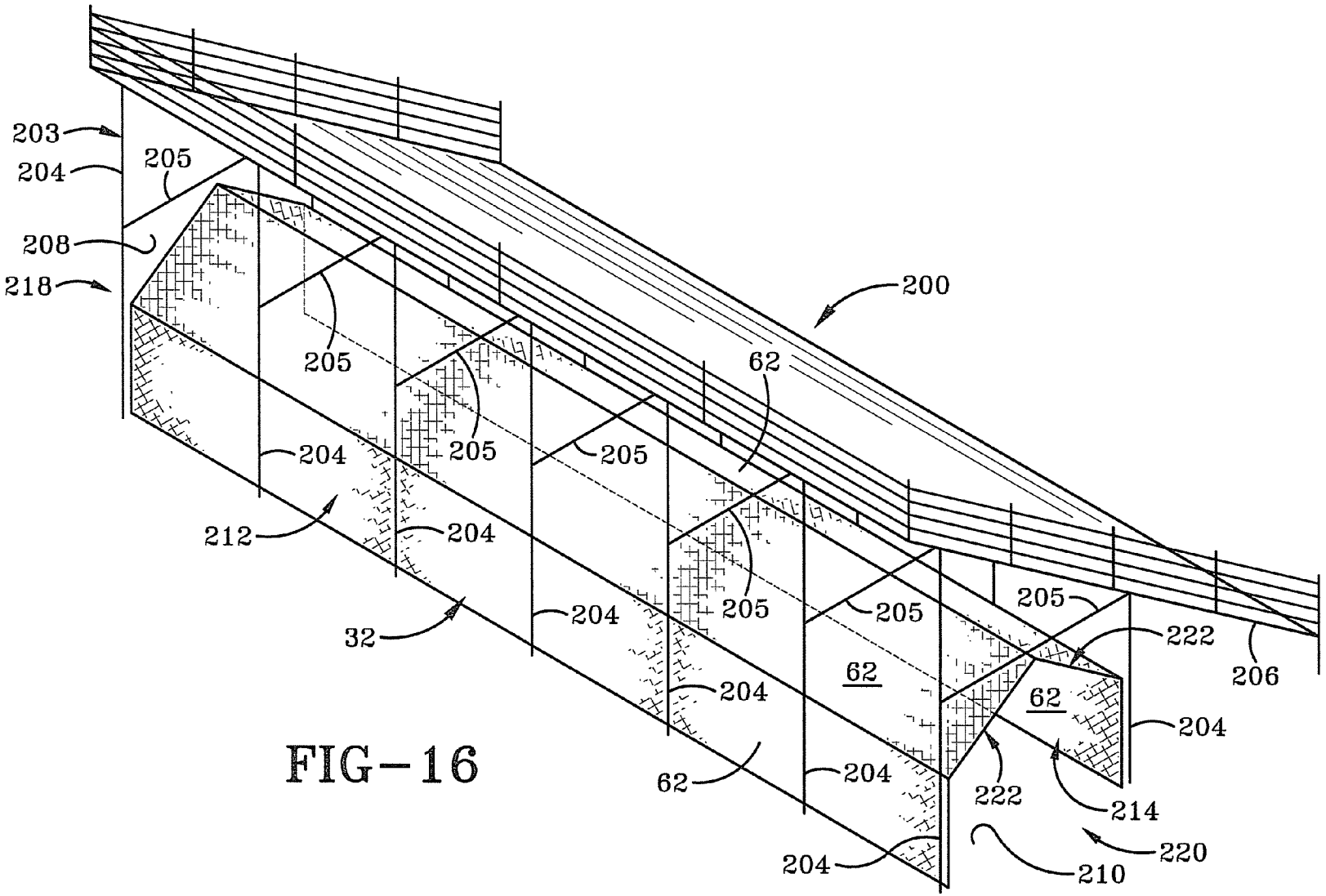
FIG. 16 is a perspective view of a third preferred embodiment of an advertising display system in accordance with the present invention showing an advertising tunnel having a ceiling panel.
Figure 17:
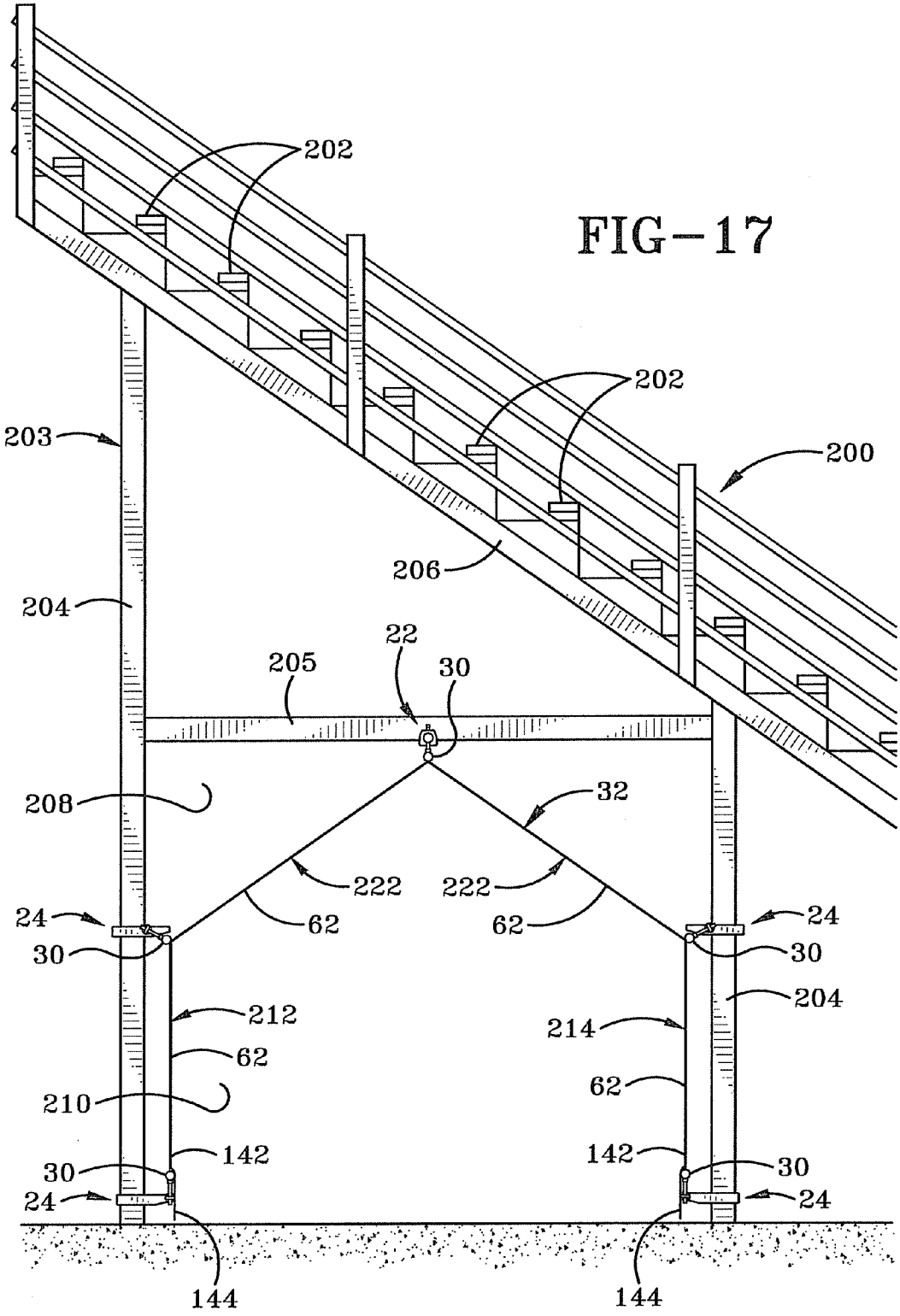
FIG. 17 is a right side elevational view of the advertising display system of FIG. 16.

FIGS. 16 and 17 illustrate a third embodiment of an advertising display system in accordance with the present invention. The third embodiment is similar to the first and second embodiments but, in this instance, the tunnel formed by first and second advertising panels 212, 214 additionally includes a ceiling panel 222. Ceiling panel 222 is secured between first advertising panel 212 and second advertising panel 214 and extends upwardly to engage with a plurality of panel fastening assemblies 22 secured at intervals to horizontal beams 205 (FIG. 17). When installed, ceiling panel 222 has an upside-down V-shape. While the third embodiment of the advertising display system is shown and described as having one or two advertising ceiling panels 222, it is within the spirit and scope of the present invention to extend first and second advertising panels 212 and 214 upwardly to engage the panel fastening assembly 22 that is secured to beam 205. In this instance, each of first and second advertising panels would be provided with one or more intermediate rings 64 positioned somewhere between the top and bottom edges of the panel. These intermediate rings 64 would be formed simply by folding a length of the sheet material back on itself and securing the two layers together. Alternatively, every alternate vertical beam 204 could be used to engage either of a top end of advertising panel 212 or 214, or the bottom end of ceiling panel 222. Advertising ceiling panel 222 preferably extends the length of the primary chamber 208 from tunnel first end 218 to tunnel second end 220 and would be provided with advertising indicia on the interior surface of the ceiling of the tunnel formed by panels 212, 214 and 222. Advantageously, this arrangement also provides protection to spectators walking through the tunnel and prevents debris falling from seating surface 202 through to the interior of the tunnel. The ceiling also provided protection from the elements as well as additional advertising space which can be sold by the stadium owner.

Figure 18:
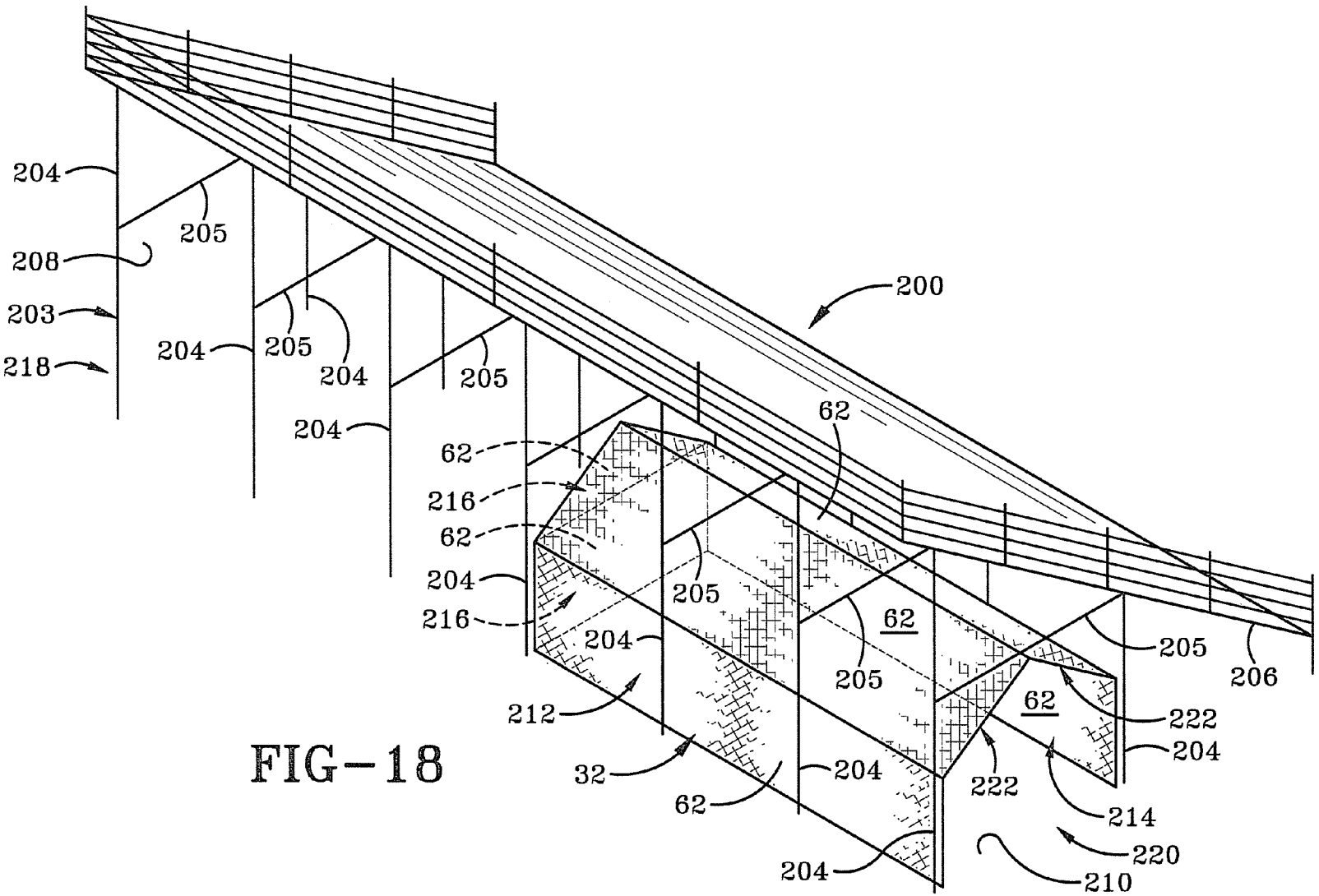
FIG. 18 is a perspective view of a fourth preferred embodiment of the advertising display system in accordance with the present invention showing an advertising tunnel having a ceiling panel and an intermediate panel.
Figure 19:
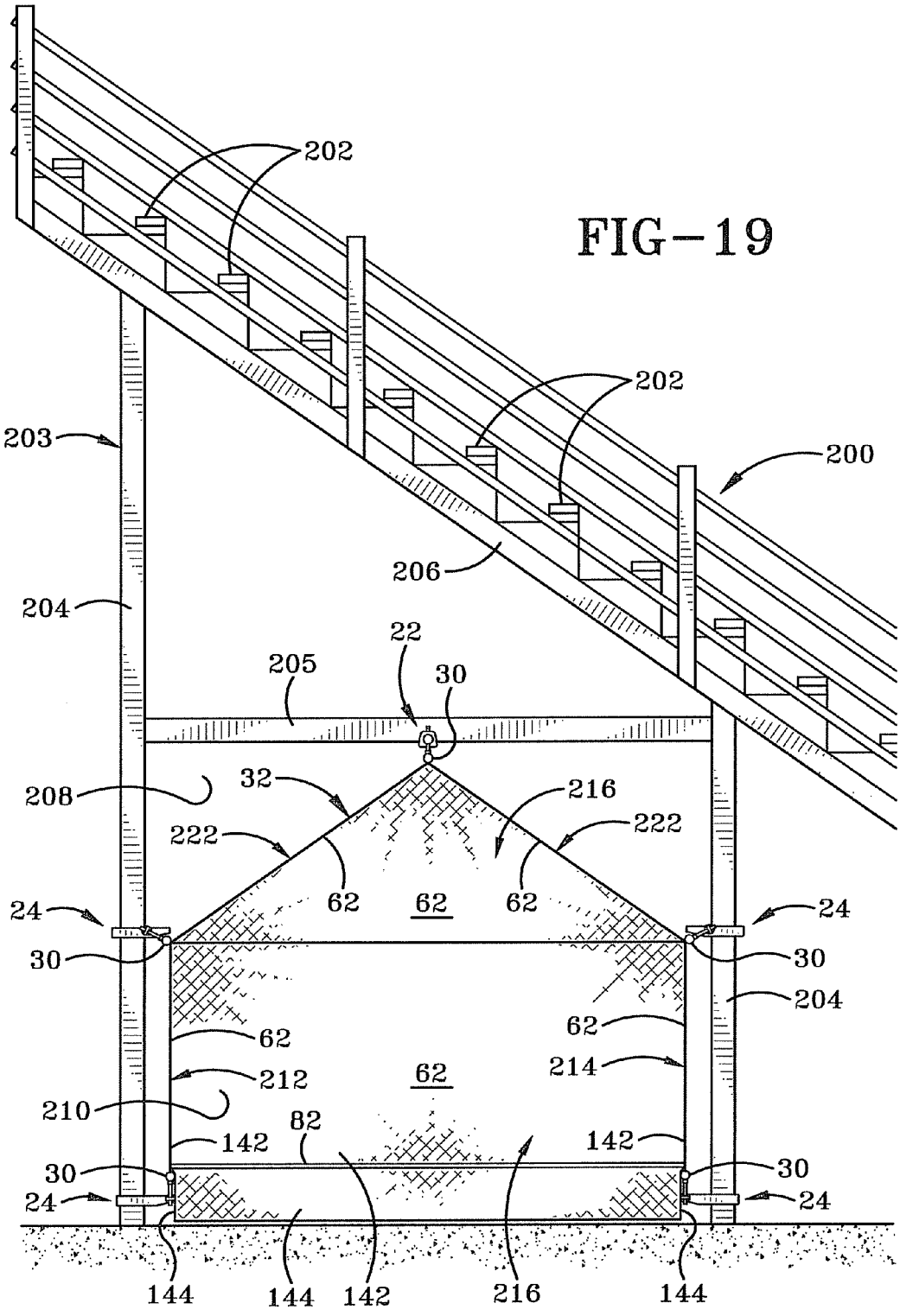
FIG. 19 is a right side elevational view of the advertising display system of FIG. 18.

FIGS. 18 and 19 illustrate a fourth embodiment of the advertising display system in accordance with the present invention in which the smaller compartment formed by panels 212, 214 and 216 is also provided with a ceiling panel 222. Intermediate panel 216 can be extended upwardly to span the gap between ceiling panel 222 and the original position of the top end of panel 216. Alternatively, a separate rear connector panel can be used to close off this gap above panel 216. Similar to the previous embodiments, this arrangement provides protection from the elements, as well as a variety of advertising portions for income generation. Further, this can be used once again as storage or a vending location.

The advertising display system in the form of the bleacher display tunnel in accordance with the present invention can be installed by any of the methods described previously, or in combinations of the four embodiments so described. While the preferred embodiments generally illustrate panel fastening assembly 24 securing the advertising panel to support beams 204, it is within the spirit and scope of the present invention to utilize either of the first and second panel fastener assemblies 22, 24 with the various tunnel embodiments without departing from the spirit and scope of the present invention as claimed.

Accordingly, the advertising display system including a bleacher and advertising panel assembly is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

Having now described the features discoveries, and principles of the invention, the manner in which the present invention is construed and used, the characteristics of the construction, and the advantageous new and useful results obtained; the new and useful structures, devices, elements, arrangement, parts, and combinations are set forth in the appended claims.

The invention claimed is:

1. An advertising display system comprising:

a bleacher having a seating surface and a plurality of support beams below the seating surface defining a primary chamber; and an advertising panel assembly mounted within the primary chamber and defining a secondary chamber; wherein the advertising panel assembly comprises:

a first advertising panel having advertising indicia thereon; and a first panel fastening assembly that secures the first advertising panel to one of the support beams to form one of a plurality of walls which define the secondary chamber; and wherein the first panel fastening assembly comprises:

a carrier engaging an end region of the first advertising panel;

an advertising track engaging the carrier;

a frame member secured to the one support beam; and a rod which extends between the frame member and advertising track and attaches them to each other; wherein said rod locks the carrier to the advertising track and is operable to change the distance between the frame member and advertising track and thus between the frame member and the first advertising panel; and wherein the change in distance adjusts the tension in the first advertising panel.

2. The advertising display system of claim 1, wherein the advertising panel assembly further comprises:

a second advertising panel; and at least a second panel fastening assembly substantially identical to the first panel fastening assembly and which secures the second advertising panel to a second one of the support beams, and wherein the second advertising panel is a spaced distance from the first advertising panel and forms another of the walls defining the secondary chamber.

3. The advertising display system of claim 2, wherein the first and second advertising panels are oriented substantially parallel to each other.

4. The advertising display system of claim 3, wherein the first advertising panel has a first and a second end, and the second advertising panel has a first and a second end, and the first ends of the first and second advertising panels are aligned with each other and the second ends of the first and second advertising panels are aligned with each other.

5. The advertising display system of claim 1, wherein the bleacher includes a front portion and a rear portion, and the seating surface is sloped downwardly from the rear portion to the front portion and includes a plurality of seats; and wherein the front portion, the rear portion, and an underside of the sloped seating surface define the primary chamber.

6. The advertising display system of claim 5, wherein the plurality of support beams is a plurality of vertical beams that extend downwardly from the support surface and are adapted to engage the ground beneath the bleacher and wherein the first advertising panel is secured to one of the vertical beams .

7. The advertising display system of claim 6, wherein the plurality of support beams further include a plurality of horizontal beams extending between the vertical beams.

8. The advertising display system of claim 1, wherein the primary chamber further comprises a first end and opposite a second end, wherein the advertising panel assembly extends between the first and second ends.

9. The advertising display system of claim 2, wherein the primary chamber further comprises a first end opposite and a second end, and the primary chamber has a longitudinal axis extending between the first and second ends, and wherein the advertising panel assembly further comprises an intermediate advertising panel and a third panel fastening assembly which secures the intermediate advertising panel to the support beams so that it is disposed at an angle relative to the longitudinal axis of the primary chamber.

10. The advertising display system of claim 9, wherein the intermediate advertising panel extends perpendicularly between the first and second advertising panels.

11. The advertising display system of claim 9, wherein the intermediate advertising panel defines a third wall of the secondary chamber and prevents passage from the first end to the second end of the primary chamber.

12. The advertising display system of claim 2, wherein the support beams define first and second longitudinal sides of the primary chamber and wherein the advertising panel assembly includes a first advertising panel mounted on the support beams along the first longitudinal side, and a second advertising panel mounted on the support beams along the second longitudinal side.

13. The advertising display system of claim 12, wherein the advertising panel assembly further comprises an intermediate advertising panel which defines a terminal side of the secondary chamber, and the intermediate advertising panel extends between the first and second advertising panels.

14. The advertising display system of claim 13, wherein the support beams define a ceiling and the advertising panel assembly further includes a ceiling advertising panel and a ceiling panel fastening assembly that is secured to the ceiling support beams.

15. The advertising display system of claim 14, wherein the ceiling advertising panel is connected to each of the first and second advertising panels.

16. The advertising display system of claim 1, wherein the frame is removably securable to the one of the support beams.

17. The advertising display system of claim 16, wherein the frame is adjustable to vary the position of the first advertising panel within the primary chamber.

18. The advertising display system of claim 17, wherein the frame is adjustable to maintain tension in the first advertising panel.

19. The advertising display system of claim 16, wherein the advertising track includes an opening and the advertising panel carrier is slidable within the opening in the advertising track.

20. The advertising display system of claim 19, wherein the advertising track further includes a slot that is in communication with the opening, and the first advertising panel extends outwardly through the slot when the advertising panel carrier is engaged in the opening in the advertising track.

21. The advertising display system as defined in claim 1, wherein the first advertising panel and rod are aligned with each other along a plane; and the rod is operable to move the first advertising panel either toward or away from the frame member along the plane.

22. The advertising display system as defined in claim 21, wherein the rod includes:

a shaft which extends outwardly from the frame member, through a hole in the advertising track, and into an interior chamber defined by the advertising track; and a nut rotatably engaged with the shaft, wherein said nut is rotated in a first direction to advance the shaft into the interior chamber, thereby reducing the length of the shaft extending between the frame member and the advertising track; and the nut is rotated in a second direction to withdraw a portion of the shaft from the interior chamber and thereby increase the length of the shaft extending between the frame member and the advertising track.

23. The advertising display system as defined in claim 22, wherein rotation of the nut in the first direction increases tension in the first advertising panel; and rotation of the nut in the second direction reduces tension in the first advertising panel.

* * * * *